US010012375B1

(12) United States Patent
Salessi

(10) Patent No.: US 10,012,375 B1
(45) Date of Patent: Jul. 3, 2018

(54) MODULAR LED LAMP

(71) Applicant: Nader Salessi, Laguna Niguel, CA (US)

(72) Inventor: Nader Salessi, Laguna Niguel, CA (US)

( * ) Notice: Subject to any disclaimer, the term of this patent is extended or adjusted under 35 U.S.C. 154(b) by 278 days.

(21) Appl. No.: 14/848,067

(22) Filed: Sep. 8, 2015

Related U.S. Application Data

(60) Division of application No. 13/410,158, filed on Mar. 1, 2012, now abandoned, which is a continuation-in-part of application No. 12/592,563, filed on Nov. 27, 2009, which is a continuation-in-part of application No. 12/454,532, filed on May 19, 2009.

(60) Provisional application No. 61/273,495, filed on Aug. 5, 2009, provisional application No. 61/273,885, filed on Aug. 10, 2009, provisional application No. 61/128,272, filed on May 20, 2008.

(51) Int. Cl.

| | |
|---|---|
| ***F21V 1/02*** | (2006.01) |
| ***F21V 7/05*** | (2006.01) |
| ***F21V 29/503*** | (2015.01) |
| ***F21K 99/00*** | (2016.01) |
| ***F21V 29/83*** | (2015.01) |
| *F21Y 101/02* | (2006.01) |

(52) U.S. Cl.
CPC ..... *F21V 29/503* (2015.01); *F21K 9/30* (2013.01); *F21K 9/50* (2013.01); *F21V 29/83* (2015.01); *F21Y 2101/02* (2013.01)

(58) Field of Classification Search
CPC ..... F21V 29/503; F21V 29/83; F21K 9/30; F21K 9/50; F21S 8/06; F21S 8/085; F21S 8/086
See application file for complete search history.

(56) References Cited

U.S. PATENT DOCUMENTS

| | | | | |
|---|---|---|---|---|
| 3,173,610 | A | 3/1965 | Feibush et al. | |
| 4,463,214 | A | 7/1984 | Lowther | |
| 4,765,139 | A | 8/1988 | Wood | |
| 5,283,723 | A * | 2/1994 | Wu | F21V 1/14 362/147 |
| 5,958,100 | A | 9/1999 | Farnworth et al. | |
| 5,975,724 | A * | 11/1999 | Pallanes | F21V 1/00 362/310 |
| 6,034,318 | A | 3/2000 | Lycke et al. | |
| 6,100,500 | A * | 8/2000 | Jefferson, Jr. | H05B 3/84 219/203 |
| 6,118,685 | A | 9/2000 | Takeuchi et al. | |
| 6,407,922 | B1 | 6/2002 | Eckblad et al. | |
| 6,482,520 | B1 | 11/2002 | Tzeng | |

(Continued)

FOREIGN PATENT DOCUMENTS

| | | |
|---|---|---|
| WO | WO2006056066 | 6/2006 |

*Primary Examiner* — Anh Mai
*Assistant Examiner* — Arman B Fallahkhair
(74) *Attorney, Agent, or Firm* — Kuta IP Law, LLC; Christine M. Kuta

(57) ABSTRACT

A lamp assembly provides light in a downward direction as well as in an upward direction through the use of angled housing walls and windows in the lamp assembly housing. Modularity and sliding elements enable the lamp assembly to be easily assembled and also easily repaired. A back cover on the lamp assembly is configured such that the lamp assembly is easily installed. Lamp heat management includes active and passive elements.

18 Claims, 36 Drawing Sheets

(56) References Cited

U.S. PATENT DOCUMENTS 6,503,626 B1 1/2003 Norley et al.
6,517,218 B2 2/2003 Hochstein
6,708,501 B1 3/2004 Ghoshal et al.
6,771,502 B2 8/2004 Getz, Jr. et al.
6,841,250 B2 1/2005 Tzeng
6,964,501 B2 11/2005 Ryan
6,976,769 B2 12/2005 McCullough et al.
7,150,914 B2 12/2006 Clovesko et al.
7,160,619 B2 1/2007 Clovesko et al.
7,208,881 B2 4/2007 Young
7,276,273 B2 10/2007 Clovesko et al.
7,280,359 B2 10/2007 Fujiwara
7,303,820 B2 12/2007 Capp et al.
7,306,847 B2 12/2007 Capp et al.
7,344,279 B2 3/2008 Mueller et al.
7,365,988 B2 4/2008 Reis et al.
7,472,506 B2 * 1/2009 Lapointe ..... G09F 13/04 362/359
7,854,534 B2 * 12/2010 Liu ..... F21V 15/01 362/294
7,959,331 B2 * 6/2011 Ho ..... F21V 15/01 362/249.02
8,230,690 B1 * 7/2012 Salessi ..... F21V 3/00 165/185
9,303,864 B2 * 4/2016 Yen ..... F21V 33/0096
2004/0122930 A1 6/2004 Pasternak
2005/0243539 A1 11/2005 Evans et al.
2005/0276053 A1 12/2005 Nortrup et al.
2005/0279949 A1 12/2005 Oldham et al.
2006/0107986 A1 5/2006 Abromov et al.
2006/0151801 A1 7/2006 Doan et al.
2006/0198149 A1 9/2006 Jonsson et al.
2006/0260793 A1 11/2006 Yang et al.
2007/0013057 A1 1/2007 Mazzochette
2007/0018175 A1 1/2007 Mazzochette et al.
2007/0042188 A1 2/2007 Clovesko et al.
2007/0053169 A1 3/2007 Sayir et al.
2007/0077434 A1 4/2007 Clovesko et al.
2007/0102033 A1 5/2007 Petrocy
2007/0158050 A1 7/2007 Norley et al.
2007/0189011 A1 8/2007 Sung et al.
2007/0222581 A1 9/2007 Hawkins et al.
2007/0278212 A1 12/2007 Okimura
2008/0083446 A1 4/2008 Chakraborty et al.
2008/0089071 A1 * 4/2008 Wang ..... F21S 2/005 362/294
2008/0158876 A1 7/2008 Thrailkill
2008/0218977 A1 9/2008 Reis et al.
2009/0040719 A1 2/2009 Chin-Fu Horng
2009/0095461 A1 4/2009 Lemak et al.
2010/0301770 A1 12/2010 Chemel et al.
2012/0007511 A1 1/2012 Choong

* cited by examiner

MODULAR LED LAMP

BACKGROUND

Gas discharge lamps and incandescent lamps are well known in the art. Gas sources and incandescent lamps have relatively high energy consumption. Further, gas sources and incandescent lamps have relatively short lifetimes and are susceptible to breakage, typically leading to high maintenance costs. Further, the light intensity of gas discharge lamps tends to decrease over time with use. Additionally, gas discharge lamps produce ozone due the hazardous material/gas they require for excitation of electrons. After a gas discharge lamp's useful life, hazardous material and poisonous gases used in the lamp are released to environment affecting, among other things, the ozone layer. Additionally, gas discharge lamps produce ultra violet light that tends to cause deterioration of many materials, damage to some living organisms, and to some elements of the environment.

Solid state lighting, such as light emitting diode (LED) lighting has been developed to overcome some of the problems of gas discharge lamps and incandescent lamps. Many conventional LED devices, however, are limited by thermal energy-management issues.

It is known that LEDs exhibit negative temperature coefficient aspects, i.e. at fixed power input, as the device's operating heat rises, the device's light output decreases and it shortens the life of LED. It is, however, desirable to run LEDs using high current, because the higher the current, the higher the brightness of the emitted light. Further, high heat during use can shorten the useful life of an LED. Accordingly, there is motivation to remove heat as much as possible in order to operate an LED optimally with regard to power input and light output and LED life.

In addition, where a plurality of LED's are required for higher brightness, there are limits in conventional lamp technology to the number of LEDs within a defined space due to the problem of heat dissipation. Accordingly, it is desirable to cool an LED device in order to maximize energy efficiency and lifespan as well as to broaden design options.

Conventional solutions to undesirable thermal buildup include fans, cooling fins, spacing assemblies, etc. to reduce lamp housing temperature. Another conventional solution involves mounting LED modules on large conductive heat sinks. A light emitting diode (LED) must be mounted on a relatively large metal heat sink to dissipate the heat when the diode is run using high current. In high use and in demanding situations, the thermal transfer from the LEDs through a thermally connected conventional heat spreading plate to the housing is insufficient to maintain a desirable LED temperature. Unfortunately, thermal back-flow may occur as a lamp housing is heated by the ambient atmosphere beyond an optimal point which allows thermal conduction back to the heat spreading plate. In such situations, rapid LED degradation often occurs and unit efficiency drops.

Solid state thermoelectric modules (TEM), also referred to as thermoelectric coolers (TEC), or heat pumps, have been used in various applications. A TEM, in a thermocooling application, converts electrical energy into a temperature gradient, known as the "Peltier" effect. By applying a current through a TEM, a temperature gradient is created and heat is transferred from one side, the "cold" side of the TEM to the other side, the "hot" side.

The Peltier effect is well known by those skilled in the related arts and provides an active solid-state thermoelectric cooling function from a cool side to a hot side. The cool side is commonly placed against a surface or substrate which requires cooling. For example, the back surface of an LED assembly. The hot side is commonly placed against a surface or substrate which absorbs the transferred thermal energy and transfers it through conduction to a heat spreading plate. Through the utilization of these thermo-electric effects, thermal transfer from a cool side to a hot side can be controlled by controlling a current supplied to the thermo-electric effect.

Many conventional solid-state lamps are expensive to manufacture, and, due to the nature of the failures in a solid-state lamp, difficult and expensive to repair. Nevertheless, the energy-efficiency characteristics of solid-state lamps make them an attractive alternative to incandescent and fluorescent lighting.

For the foregoing reasons, there is a need for a solid-state lamp having effective thermal management with improved maintenance qualities.

SUMMARY

A solid-state lamp has an efficient, reliable and flexible design. Modules of LEDs are supported in a frame enclosed in a housing. The frame has a number of angled panels supporting the modules at angles. The angled panels increase the angle of illumination from the lamp. The inner lamp housing and the frame are reflective and direct light substantially in the direction that the LEDs face. Some light, however, is directed in a secondary direction through upward facing windows in the housing. In order to maintain efficient light output from a lamp including LEDs, especially a lamp including high brightness LED arrays, it is beneficial for the lamp to be provided with an effective heat removal system. The heat removal system is connected in some embodiments to a heating element in the lamp covers to prevent fogging and icing in inclement weather.

In one lamp embodiment, angled extensions on each panel of the frame further increase the angle of illumination provided by the lamp in the primary direction of illumination, that is, the direction in which the LEDs are substantially facing. This configuration provides a larger spread of light which is advantageous for aisles, covered parking structures, and parking lots.

In another embodiment, the frame is centered in the housing with sufficient clearance from the edge of the fixture for maximum light projection in the primary direction of illumination.

In another embodiment, upward facing windows provide light upward thereby illuminating the space above the lamp. This tends to eliminate the cave effect that LED light fixtures have due to their inherent directional light characteristic.

In another embodiment of the lamp, a protective glass cover is readily removed and replaced. In one arrangement, the cover is set into the housing with a gasket. The cover is removable to service the lamp and is then replaceable to secure the fixture against dust and rain substantially back to the original condition. The servicing of the unit can be done in the field and its IP rating remains as that for the original fixture. By pushing the glass down, the glass holder slides out. Then the glass can be removed and LEDs can be serviced. Then the glass is put back. The glass is pushed up by the force of the rubber gasket. While pushing down on the glass, the 2 side glass holder are slid into the place and once the glass is released (or pushing down on glass is removed), the glass is pushed against the side metal rails and it would be water tight. In another embodiment of the lamp, the housing has ventilation openings as part of the passive cooling system for the LED modules. Each module includes at least one heat sink. The heat sinks are configured and located to enable effective passive cooling through air circulation. The housing in alternative arrangements includes a sliding bracket on the top and a hinged top cover enabling quick and simple installation. For example, in one arrangement, railings on the housing are configured to engage with inwardly bent edges on the top cover. This configuration enables the lamp fixture to be held in suspense while an installer is servicing the lamp or connecting wires for installation.

In another embodiment of the lamp, the glass cover protecting the LEDs includes a heat element. Heat at the heat sinks located on the LED modules is collected by thermal generators and converted to DC current. The current is supplied to the heat element in the glass to melt ice build up on the glass in the subfreezing weather.

The present invention together with the above and other advantages may best be understood from the following detailed description of the embodiments of the invention illustrated in the drawings, wherein:

DRAWINGS

DESCRIPTION

A solid-state lamp is constructed using a plurality of replaceable and re-arrangeable LED modules. The replaceable modules typically include at least one light source module and a power supply module. The replaceability of the modules simplifies maintenance and repair of the lamp. The modules are supported in a frame enclosed in a housing. The frame has a number of angled panels supporting the modules at angles. The angled panels increase the angle of illumination from the lamp. The inner lamp housing and the frame are reflective and direct light substantially in the direction that the LEDs face. Some light, however, is directed in a secondary direction through upward facing windows in the housing. In an alternative embodiment, one or more upwardly directed LEDs are located behind the windows to increase the uplight from the lamp assembly. In a further alternative embodiment, strips of LEDs are located behind the windows. These upwardly directed LEDs are secured to the top side of a heat sink for proper heat transfer and heat dissipation.

An example implementation of the solid-state lamp assemblies is a networked configuration for lighting control in an indoor space such as a warehouse. The network enables the lamp assemblies (also referred to as "lamps") to communicate with each other and with badges carried by the warehouse workers. As the workers move about the warehouse, the lamps provide more or less light in response to worker proximity. The response time for the system described is typically faster than conventional motion detector systems. Further, the lamp senses the presence of a badge in proximity to it and remains on even if the worker is substantially stationary for a prolonged period.

Figure 1:
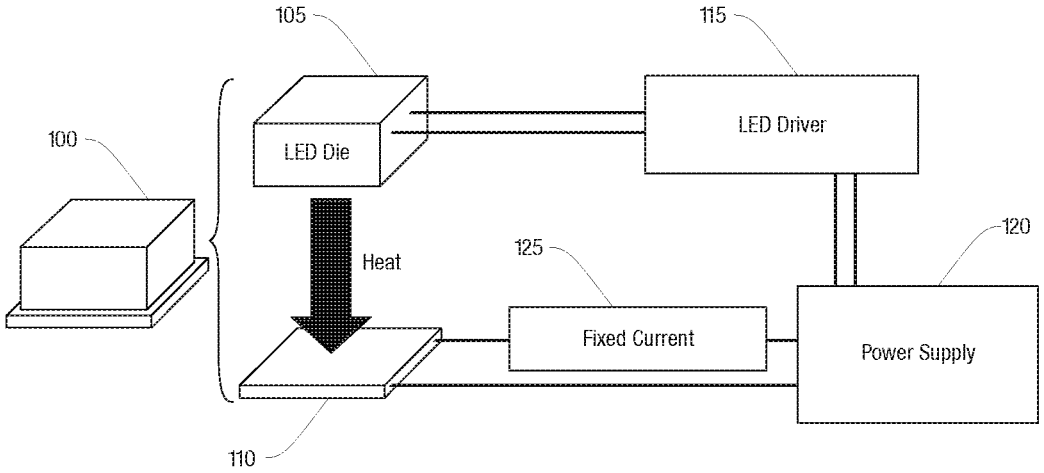
FIG. 1 is a diagram illustrating a unit of a high-power LED lamp according to principles of the invention.

FIG. 1 shows a light engine unit according to one embodiment of the invention. The light engine unit ("the unit") 100 includes an LED die 105 thermally engaged with a cooling device 110. The LED die 105 is electrically coupled to an LED driver 115. A power supply 120 powers the LED driver 115 and supplies a fixed current 125 to the cooling device 110.

The LED die 105 is, for example, a chip of semiconducting material impregnated with impurities to create the p-n junction and configured to emit light when electrically biased. The LED die 105 has a thickness, for example, of 100-150 micrometers. The cooling device 110 is, for example, a thermo-electric device and is thermally engaged with the LED die such that heat is directed away from the LED die. An example thermo-electric device has a thickness of 10 micrometers. The thermo-electric device, also referred to as Peltier device, removes heat from the LED die through the Peltier effect. The thermo-electric device creates a temperature difference in response to an applied voltage. In one embodiment, the thermo-electric device is a thin film micro cooling device. In another embodiment, the thermo-electric device is a nanotechnology device. The cooling device is for example a nanocooler available from nanoCoolers of Austin, Tex. Alternatively, the cooling device is a thin film thermoelectric device available from Micropelt GmbH of Freiburg, Germany. In one embodiment, the cooling device is coupled to the LED die using conventional semiconductor attachment method such as soldering. In an alternative embodiment, the LED and the cooling device are manufactured together using micro processes or further alternatively using nanotechnology processes. In a preferred embodiment, the micro or nano manufacturing produces a layered LED/cooling device structure. The present invention, however, is not limited by the method of thermally coupling the LED die 105 to the cooling device 110.

The LED driver 115 is a typical LED driver. The power supply 120 is configured to supply a predetermined fixed current 125 to the cooling device 110. In a first embodiment of the invention, the fixed current 125 is based on typical junction temperature of the LED. In another embodiment, the fixed current 125 is based on typical usage and design of the lamp in which the LED unit 100 operates. Example applications of a lamp according to the present embodiment are a street lamp, parking lot lamp and a parking structure lamp. Accordingly, typical usage factors include weather factors and other environmental factors as well as lamp design. Another factor that may be used in determining the fixed current is average ambient temperature around the lamp in operation.

In operation, the LED die 105 emits light in response to the LED driver 115 which are both powered by the power supply 120. The cooling device 110 is supplied with a fixed current 125 by the power supply 120 and operates to cool the LED die 105. Operating the cooling device 110 at the fixed current 125 enables the unit 100 to operate without a controller thereby realizing both a cost savings and a form factor benefit in saving space that would be otherwise occupied by housing a controller.

Figure 2:
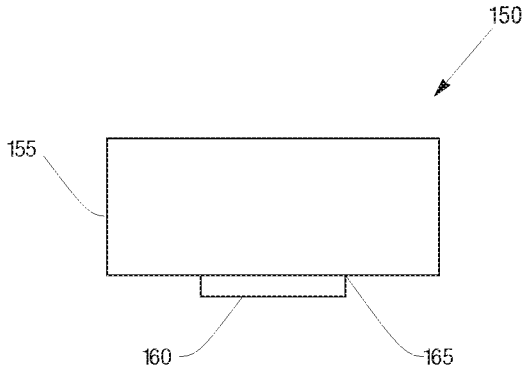
FIG. 2 is a side view of a unit of a high-power LED lamp showing advantageous positioning of a thermo electric cooling device according to principles of the invention.

FIG. 2 shows an alternative embodiment of a high-power LED unit wherein the thermo-electric device is advantageously positioned. The unit 150 includes an LED die 155 and a cooling device 160. The LED die 155 and cooling device 160 are thermally coupled together. An LED die in some configurations has a hot spot 165. In this embodiment, the cooling device 160 is positioned to provide cooling at the hot spot 165 of the LED die 155. This embodiment has the benefit that cooling is provided at the location where it is most needed. Positioning the cooling device directly against the LED die tends to maximize efficiency because the cooling is concentrated substantially on the LED die where thermal energy is generated and not on the surrounding elements.

Figure 3:
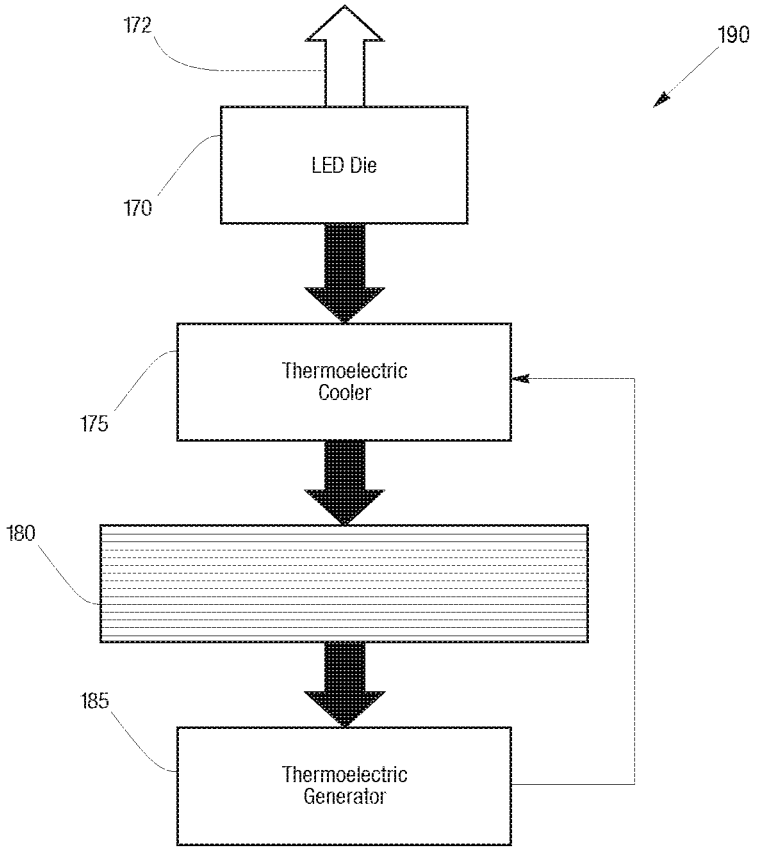
FIG. 3 illustrates an alternative embodiment of a unit of a high-power LED lamp according to principles of the invention.

FIG. 3 shows a further alternative embodiment of a high-power LED unit in diagram format. The LED unit 190 includes an LED die 170 emitting light 172, a thermoelectric cooler 175, a heat sink 180 and a thermoelectric generator 185. The thermoelectric generator 185 is for example the dTEG UPF40 Power Generator available from Nextreme Thermal Solutions, Inc. of Durham, N.C. In the LED unit 190, the LED die 170 is thermally coupled to the thermoelectric cooler 175. The thermoelectric cooler 175 is further thermally coupled to the heat sink 180. The heat sink 180 is further thermally coupled to the thermoelectric generator 185. The thermoelectric generator 185 is electrically coupled to the thermoelectric cooler 175.

In operation, the LED die 170 emits light and generates heat. The thermoelectric cooler 175 takes DC current as input and transfers heat from the LED die coupling to the heat sink coupling thereby removing heat from the LED die 170. The heat sink 180 dissipates heat passively. At least some of the heat from the heat sink 180 is transferred to the thermoelectric generator 185. The thermoelectric generator 185 generates a DC current. The DC current is received by the thermoelectric cooler 175 and is a portion of the energy needed for the operation of the thermoelectric cooler 175. The thermoelectric cooler 185 thus provides additional cooling that enables the heat sink 180 to be reduced in size over a heat sink needed in a configuration without the thermoelectric cooler 175.

Figure 4:
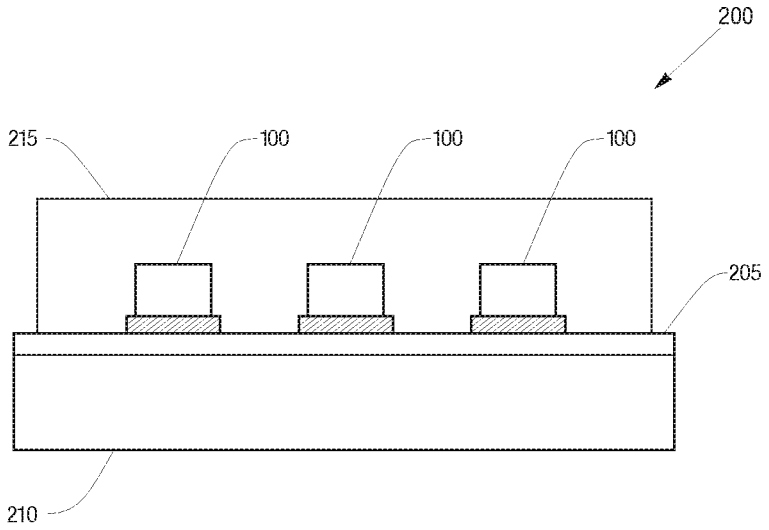
FIG. 4 is a side view of an LED module for a high-power LED lamp according to principles of the invention.

FIG. 4 is a side view of an LED module 200 for a high-power LED lamp according to one embodiment of the invention. The LED module 200, shown in side view, has a substrate 205 supporting a number of LED units 100. The substrate 205 provides electrical interconnection from the LED units 100 to the LED driver 115 (not shown) and power supply (not shown). In one embodiment, the LED module 200 is configured to fit into a support array of such modules to form a solid state lamp according to one embodiment of the invention. This will be described in further detail below. In another embodiment of the invention, the LED module 200 is configured to couple both physically and electrically with other additional modules to form a solid state lamp. A cover 215 encloses the LED units 100. In a first embodiment, the cover 215 is substantially transparent and is merely protective of the LED die. In a second embodiment, the cover 215 includes an optical lens that directs the emitted light. In a third embodiment, the cover 215 is a diffuser to diffuse the emitted light. In a still further embodiment, the substrate 205 is coupled to a conductive plate 210 such as a metal heat sink. The heat sink provides additional cooling for the solid state lamp.

Figure 5:
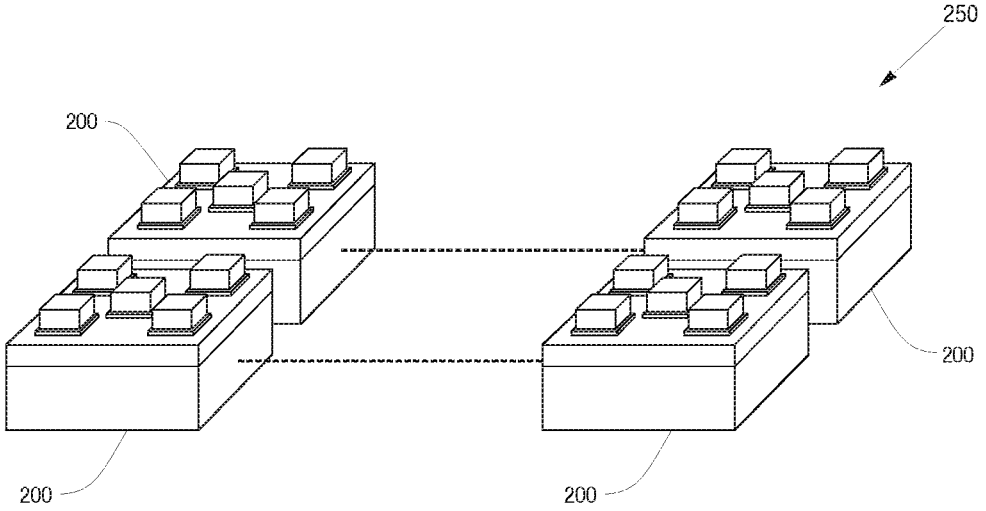
FIG. 5 is a perspective view of a collection of LED modules according to principles of the invention.

FIG. 5 is a perspective view of collection 250 of LED modules 200 according to one embodiment of the invention. As described above, in one embodiment, the LED modules 200 are configured and adapted to a support array forming a solid state lamp. The LED modules 200 are interchangeable and replaceable enabling efficient lamp maintenance. A failed module can easily be replaced. In a second embodiment, the LED modules 200 are configured to connect together to form the solid state lamp.

Figure 6:
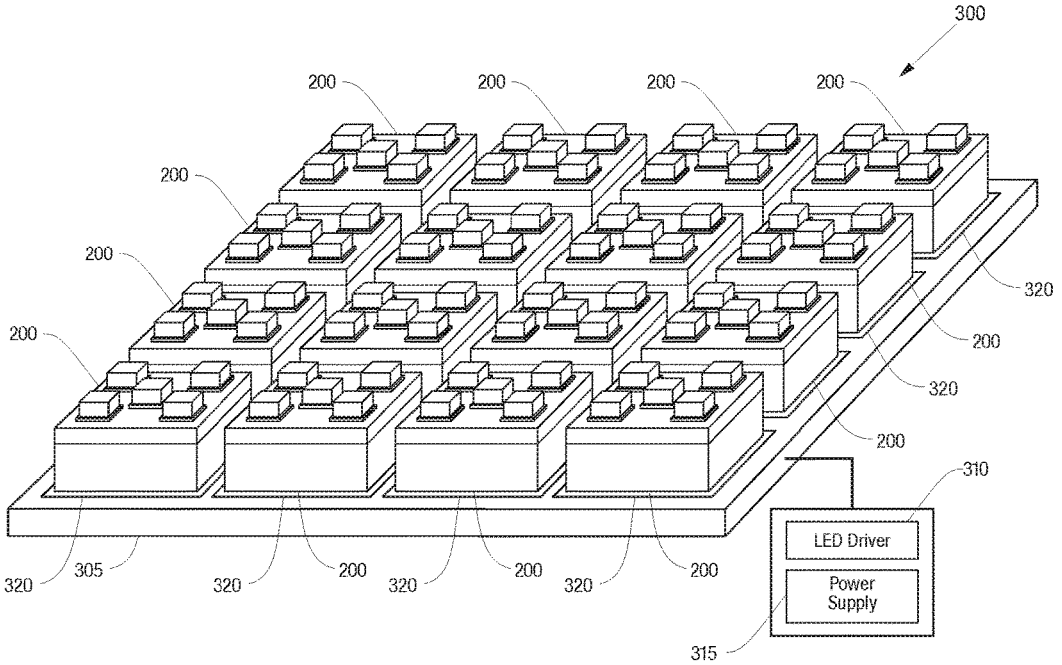
FIG. 6 is a perspective view of an array of LED modules in a high-power LED lamp according to one embodiment of the invention.

FIG. 6 is a perspective view of a high-power LED lamp 300 with the power supply and LED driver in diagram according to one embodiment of the invention. The lamp includes an array of LED modules 200. As described above, each LED module includes a plurality of units. The array of LED modules 200 is supported by a substrate 305. The substrate 305 includes a plurality of locations 320, each location 320 providing physical and electrical interconnect for an LED module 200. This substrate arrangement allows LED modules 200 to be easily removed and replaced. This greatly reduces maintenance expense as only individual modules may be replaced when needed rather than an entire lamp. An LED driver 310 drives the LEDs through connections in the substrate 305. A power supply 315 supplies power for the lamp and, in particular, supplies a constant current to the thermo-electric cooling devices, also through connections in the substrate 305, in the units.

Figure 7:
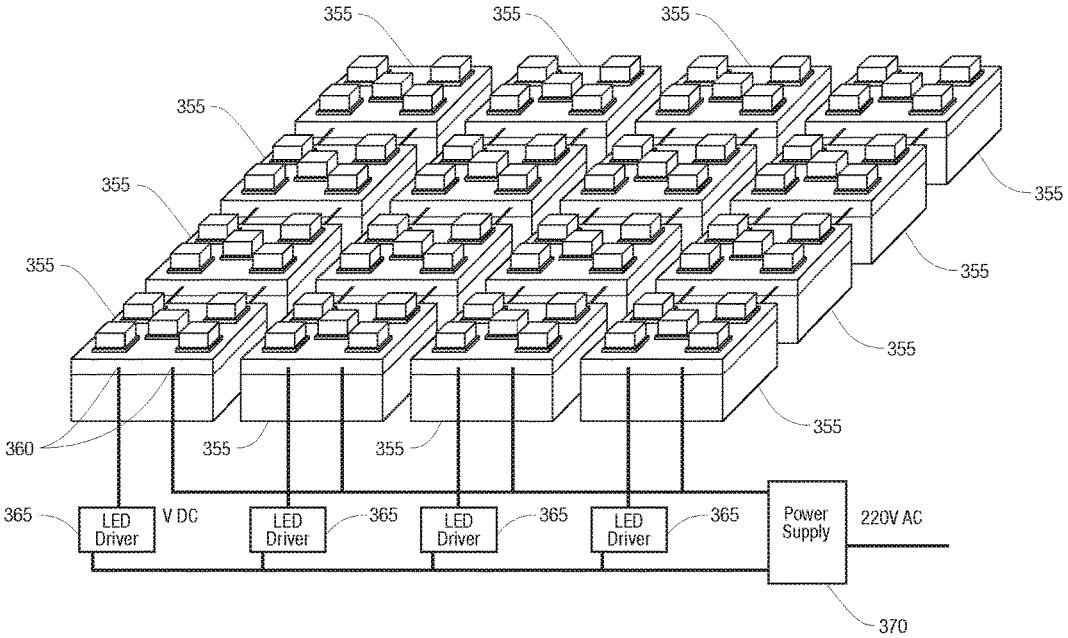
FIG. 7 is a perspective view of an alternative arrangement of an array of LED modules in a high-power LED lamp according to principles of the invention.

FIG. 7 is a perspective view of an alternative embodiment of a high-power LED lamp 350 with the power supply and driver in diagram. The lamp 350 includes an array of LED modules. The LED modules 355 in this arrangement include physical and electrical connections 360 enabling each LED module 355 to mate with any other LED module 355. This arrangement enables the LED modules 355 to be replaceable within the array. In this arrangement, each of a plurality of LED drivers 365 drive one row of LED modules 355 in the array. A power supply 370 supplies power for the lamp and also supplies a constant current to the thermo-electric cooling devices (not shown) in each unit in the LED modules 355.

Figure 8:
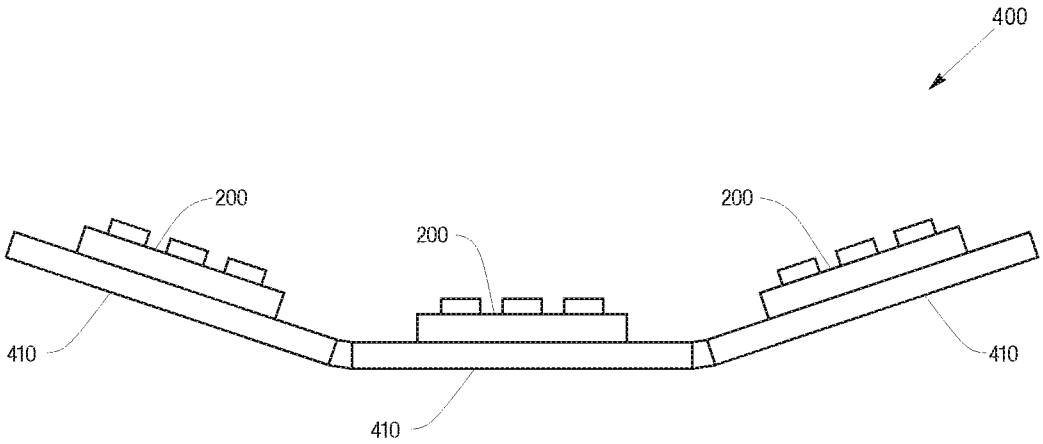
FIG. 8 is a side view of another alternative arrangement of an array of LED modules in a high-power LED lamp according to principles of the invention.

FIG. 8 is a side view of a further alternative embodiment of a high-power LED lamp according to principles of the invention. The LED lamp 400 includes a plurality of LED modules 200. The plurality of LED modules 200 is mounted to substrates 410. The substrates 410 support the LED modules 200 in a non-planar arrangement. Only three LED modules 200 are provided in the illustration for the sake of clarity. The arrangement of substrates 410 and LED modules 200 shown is just one of many possible arrangements and is provided to illustrate that the LED modules may be configured as may be appropriate for a specific application such as area lighting, theatre lighting, parking structure lighting or street lighting. This list is merely exemplary. Other embodiments are possible within the scope of the invention.

In a first arrangement, the LED modules 200 are physically and electrically coupled into the lamp 400 through the substrates 410, the substrates 410 providing conductive connections. In an alternative arrangement, the LED modules 200 are physically coupled to the substrates 410 but electrically coupled though connections between the LED modules 200. In one embodiment, the LED modules 200 have covers as described above with regard to FIG. 3. In a second embodiment, the lamp 400 includes a cover protecting all the LED modules. In a third embodiment, the lamp 400 includes focusing elements. Further alternative embodiments include diffusion elements.

Figure 9:
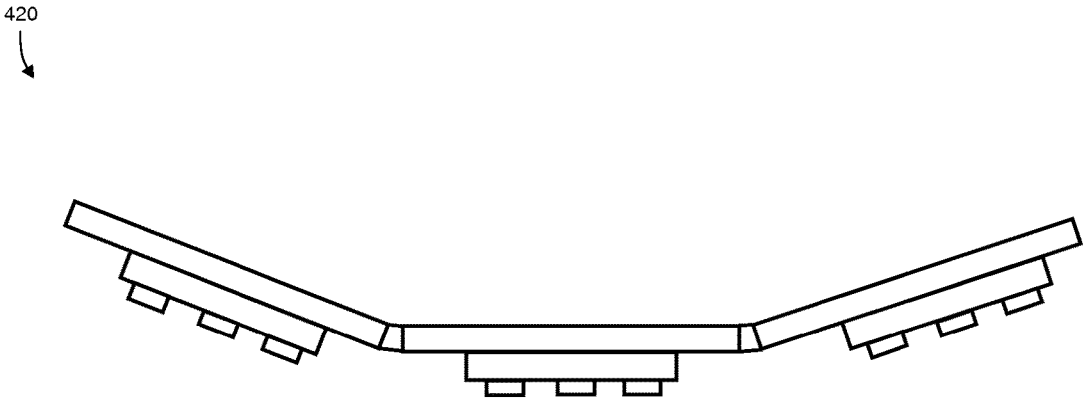
FIG. 9 is a diagram of a still further alternative arrangement of an array of LED modules in a high-power LED lamp according to principles of the invention.

FIG. 9 shows an alternative arrangement of LED modules 420 of a high-power LED lamp to that shown in FIG. 8.

Figure 10:
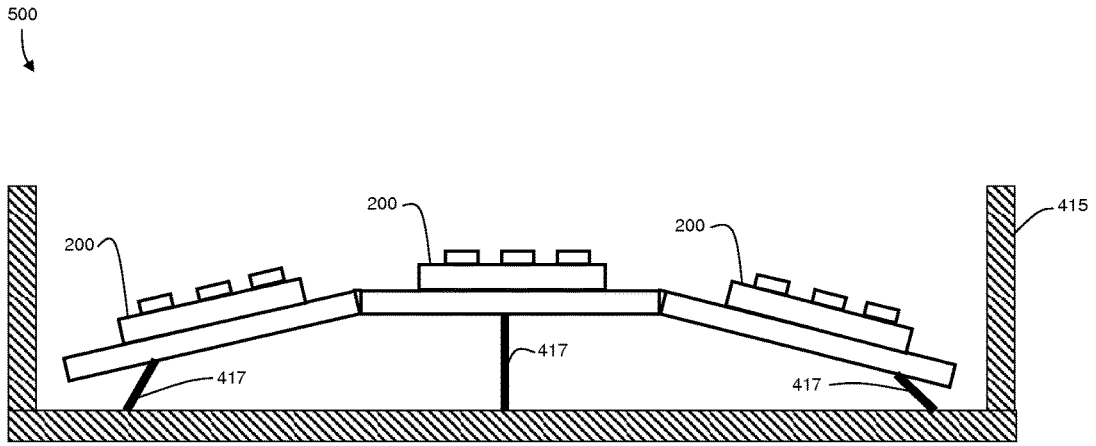
FIG. 10 is a diagram of an alternative embodiment of the high-power LED lamp according to principles of the invention.

FIG. 10 is a further alternative embodiment of a high-power LED lamp 500. In this embodiment, the LED modules 505 are enclosed in a heat conductive housing 415. Each LED module 200 is thermally coupled to the housing 415. In a first arrangement, the thermal coupling of an LED module to the housing is accomplished through a copper ribbon 417. The housing 415 in this embodiment performs as an additional heat sink in addition to those coupled to the LEDs on the LED modules. The heat sinks on the LEDs in this embodiment may therefore be smaller than in other embodiments resulting in an LED lamp that correspondingly weighs less.

Figure 11:
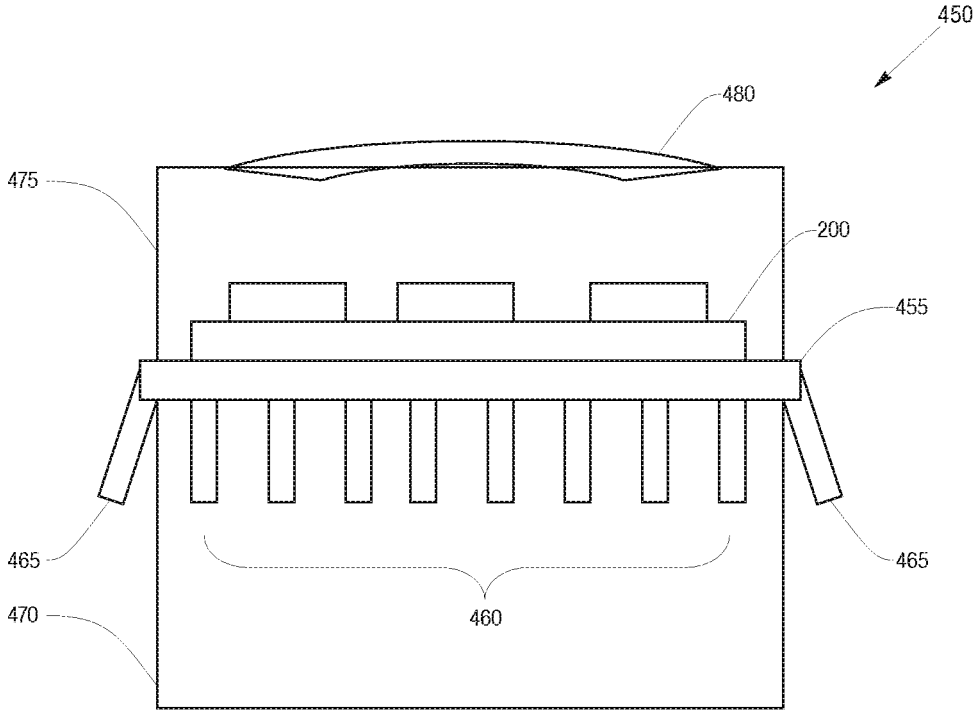
FIG. 11 is a side view of a high-power LED lamp according to another alternative embodiment of the invention.

FIG. 11 is a side view of a high-power LED lamp 450 according to principles of the invention where the high-power LED lamp is suitable for use, for example, as a spot light or a stage light. An LED module 200 as described above is coupled to a heat sink 455 having a plurality of fins 460, 465. A lower housing 470 supports the heat sink 455 and the LED module 200 and contains some of the heat sink fins 460. An upper housing 475 encloses the LED module 200 and supports an optical lens 480 configured to diffuse light from the LED module 200. The heat sink and fins 465 extend outside of the housings 470, 475 for cooling purposes. In the present embodiment, only one LED module 200 is shown for convenience. In a typical application, a plurality of modules would be included in the lamp.

Figure 12:
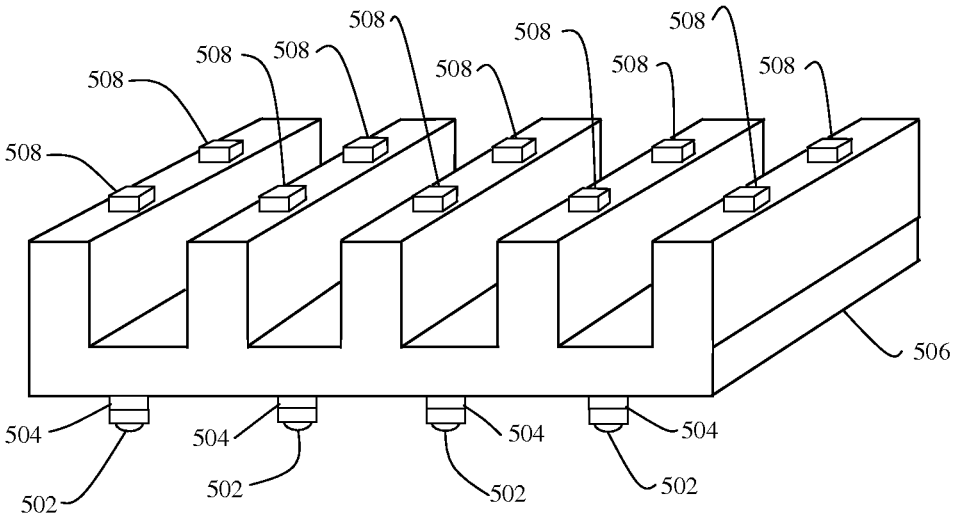
FIG. 12 is a perspective view of an active cooling system for a solid-state lamp according to principles of the invention.

FIG. 12 is a perspective view of an active cooling system for a solid-state lamp according to an embodiment of the invention. The solid-state lamp includes a plurality of LEDs 502. Each LED 502 is in thermal contact with a first side of a thermo cooler 504, also referred to as a Peltier device. A second side of each thermo cooler 504 is in thermal contact with a carbon based material heat sink 506. In a first embodiment, the heat sink is made, for example, of a compressed graphite pad with thickness of 2-3 mm. In a second embodiment, the heat sink is made of a Highly Ordered Pyrolytic Graphite or a highly oriented pyrolytic graphite block with the thickness of 20-50 mm (HOPG) (where the angular spread between each sheet is less than 1 degree) with thermal conductivity if (x, y, z to be at least 400 W/mK). In a third embodiment, the heat sink is made of a nanotube (carbon based) material with very high thermal conductivity along the tube axis Graphite material suitable for use in the present invention is available from T-Global Technology, Ltd. Taipei, Taiwan. A plurality of thermal generators 508 is positioned in thermal contact with the heat sink 506. In the present embodiment, the heat sink 506 has a finned design and the thermal generators 508 are positioned at ends of the fins opposing the location of the thermo coolers and LEDs.

In operation, the LEDs 502 provide light and generate heat. The thermo coolers 504 are powered electrically and draw heat away from the LEDs 502. The heat sink 506 provides further heat spreading and dissipation. Some of the heat flows from the LEDs generating heat across the heat sink 506 and up the fins to the thermo generators 508. The thermo generators 508 generate electrical power from heat from the heat sink 506. This electrical power is provided to the thermo coolers 504 as a portion of the power needed for their operation.

Figure 13:
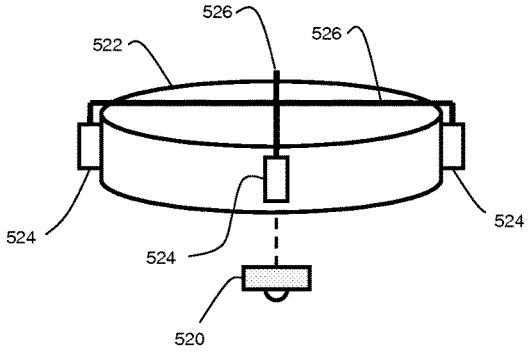
FIG. 13 is a perspective view of an alternative embodiment of an active cooling system for a solid-state lamp according to principles of the invention.

FIG. 13 is a perspective view of an alternative embodiment of an active cooling system for a solid-state lamp. An LED 520 is in thermal contact with a heat sink 522. In an alternative arrangement, an array of LEDs is positioned in thermal contact with the heat sink 522. In this embodiment, the heat sink 522 is made of thermally conductive graphite. Further, the heat sink 522 has a generally cylindrical shape. The cylindrical shape is advantageous as some of the graphite materials have good x, y thermal conductivity (e.g. 200-400 W/mK), but have poor thermal conductivity in the z direction (e.g. 2-5 W/mK). A plurality of thermo generators 524 is located on the curved surface of the heat sink 522. In one arrangement, the thermo generators 524 are spaced substantially equi-distant along the circumference of the heat sink 522. An electrically conductive cable 526 is connected to each thermo generator 524. Each of the cables 526 is of a type and design such that it is also capable of providing physical support for the thermo generator 524.

In operation, the LED 520 generates heat, some of which flows to the heat sink 522. The thermo generators 524, which are in thermal contact with the heat sink 522, generate electrical current from heat received from the heat sink 522. The current flows through the cables or PCB traces and is provided back to LED(s) 520 as a portion of current needed for their normal operation.

Figure 14:
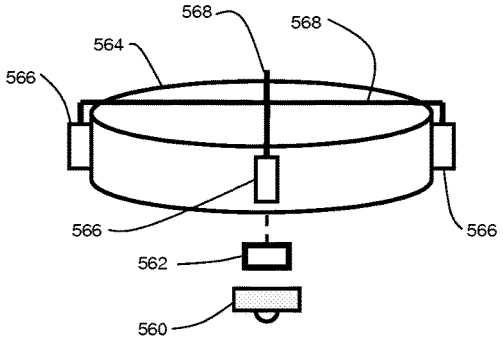
FIG. 14 is a perspective view of an alternative embodiment of an active cooling system according to principles of the invention.

FIG. 14 is a perspective view of an alternative embodiment of an active cooling system for a solid-state lamp. An LED 560 is in thermal contact with an active cooling device 562. The active cooling device 562 is, for example, a nanocooler. In a second arrangement, each of an array of LEDs is in thermal contact with an active cooling device 562. The active cooling device 562 is in thermal contact with a heat sink 564. In this embodiment, the heat sink 564 is made of graphite and has a generally cylindrical shape. The graphite heat sink has, for example, a thermal conductivity of 400 W/mK. A plurality of thermo generators 566 is located on the curved surface of the heat sink 564. In one arrangement, the thermo generators 566 are spaced substantially equi-distantly over the circumference of the heat sink 564. An electrically conductive cable 568 is connected to each thermo generator 566. Each of the cables 568 is of a type and design that is also capable of providing physical support for the thermo generator 566.

In operation, the LED 560 generates heat some of which flows to the active cooler 562. Some of the generated heat flows to the heat sink 564. The thermo generators 566, which are in thermal contact with the heat sink 564, generate electrical current from heat received from the heat sink 564. The current flows through the cables 568 and is provided to the active cooler 562. Since the active cooler 562 pumps heat away from the LED(s) 560, which are sources of heat, and the graphite heat sink is typically more efficient in thermal conductivity than aluminum, and the thermo generators provide some of the power for the active coolers, the cooling system of the present embodiment is typically smaller and lighter in weight than conventional cooling systems. The cooling system is typically more efficient in heat management and accordingly the LEDs can be operated at higher power while maintaining longevity. Further, the cylindrical shape of the heat sink in FIGS. 13 and 14 efficient shapes for dispersing heat from a centrally located heat source, i.e. an LED or an array of LEDs.

Figure 15:
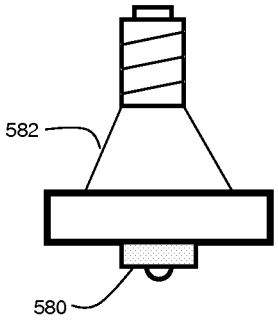
FIG. 15 is a side view of a lamp embodiment capable of using embodiments of the cooling system.

FIG. 15 is a side view of a lamp embodiment capable of using embodiments of the cooling system. The lamp has at least one LED 580. In an alternative arrangement, the lamp has an array of LEDs. The LEDs provide light and also generate heat. The LEDs are contained in a housing 582 that also includes a cooling system such as one of those described above particularly with regard to FIGS. 13 and 14. The cooling system enables the lamp to operate efficiently. The cylindrically-shaped systems complement the shapes of rounded lamps.

Figure 16:
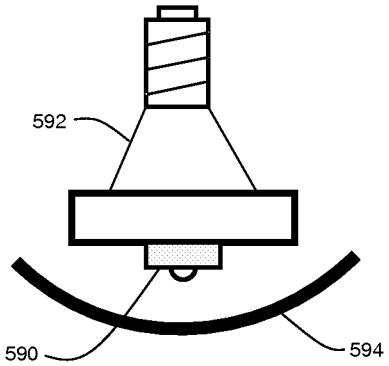
FIG. 16 is a side view of a lamp embodiment according to principles of the invention.

FIG. 16 is a side view of another lamp embodiment according to principles of the invention. The lamp has at least one LED 590. In an alternative arrangement, the lamp has an array of LEDs. The LEDs provide light and also generate heat. The LEDs are contained in a housing 592 that also includes a cooling system such as one of those described above. The cooling system enables the lamp to operate efficiently. A diffuser 594 is located in front of the LEDs configured to diffuse the light from the LEDs.

Figure 17:
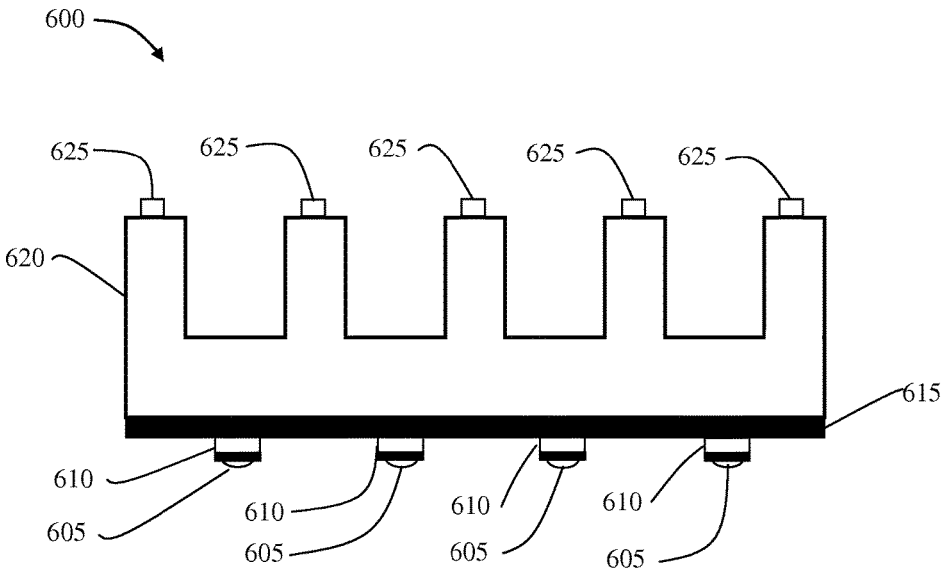
FIG. 17 is a side view of an embodiment of an active cooling system according to principles of the invention.

FIG. 17 is a side view of an alternative embodiment of an active cooling system for a solid-state lamp 600. The solid-state lamp 600 includes a plurality of LEDs 605. Each LED 605 is in thermal contact with a first side of a thermo cooler 610, also referred to as a Peltier device. A second side of each thermo cooler 610 is in thermal contact with a graphite pad 615. The graphite pad typically has thickness in order of 0.1-5 mm. The graphite pad 615 is in thermal contact with a heat sink 620. The heat sink 620 is made of thermally conductive material such as copper or aluminum. In an alternative embodiment, the heat sink is made of a carbon-based material similar to the graphite pad. A plurality of thermal generators 625 is positioned in thermal contact with the heat sink 620. In the present embodiment, the heat sink 620 has a finned design and the thermal generators 625 are positioned at ends of the fins opposing the location of the thermo coolers 610 and LEDs 605.

Some graphite materials suitable for use in thermal management have good x, y thermal conductivity, but poor z direction thermal conductivity. In the present embodiment, the graphite in the graphite pad 615 is oriented to transfer heat to the heat sink 620. The heat sink 620 is typically selected to have good thermal conductivity in the x, y and z direction. The arrangement in this embodiment is efficient as it removes the heat from the LEDs and distributes the heat in the x and y directions rapidly. The heat sink with fins receives heat from the graphite pad and dissipates the heat to the air.

Figure 18:
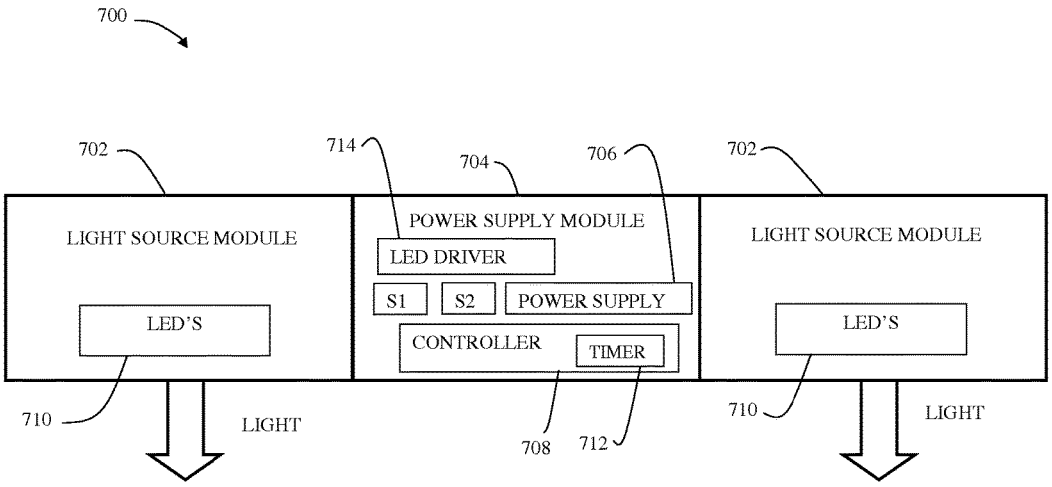
FIG. 18 is a block diagram of a modular solid-state lamp according to principles of the invention.

FIG. 18 is a block diagram of a modular solid-state lamp 700 according to principles of the invention. One example embodiment of the modular solid-state lamp, also referred to as the "fixture" is a low power consumption light emitting diode (LED) fixture. The lamp, in the present embodiment, has three sections or "modules". In the block diagram, there are light source modules 702 on either side of a power supply module 704. The light source modules 702 include a plurality of LEDs 710.

The power supply module 704 houses a power supply 706 that powers the light source modules 702 and an LED driver 714 to drive the LEDs in the light source modules 702. The power supply module 704 further includes sensors: a light sensor S1 to sense daylight and a motion sensor S2. One of the ordinary skill in the art will understand that other types of sensors are possible in alternative embodiments of the power supply module 704. The power supply module 704 further includes a controller 708. The controller 708 in one arrangement includes a timer. In another arrangement, the controller includes a dimmer. The sensors S1 and S2 and controller 708 increase the energy efficiency of the fixture 700. In one alternative embodiment, the controller 708 is programmable enabling a user to provide on-off settings and establish thresholds for lamp operation. In operation, the controller 708 responds to sensor data to turn the lamp on or off (or alternatively to dim the lamp) when the sensors do not detect movement in the room or detect that the light level, from windows for example, is sufficient. In those embodiments where a timer is present, the controller operates the lamp according to timed thresholds and periods. In an alternative embodiment of the power supply module 704, one of the sensors, for example S1, is instead a transceiver operable in a radio frequency network such as a ZigBee network. In this embodiment, the controller 708 further operates to respond to transceiver signals in operating the lamp. This operation is described in greater detail below with regard to FIGS. 34-36.

Embodiments of the housing of the power supply module 704 include a mesh screen as one side of the housing (shown in subsequent figures). The screen enables air to flow through the power supply module 704. In one embodiment, the housing has openings on the sides to enable air flow also through the light source modules 702. This air flow cools the power supply 706 and the LEDs in operation. The power supply 706 is preferably sized and configured such that there are spaced between the power supply and all four walls of the power supply module housing so that there is air flow fully around the power supply thereby passively cooling the power supply module 704.

The light source modules 702 are formed and configured such that they can be attached at the ends of the power supply module 704 or at the sides of the power supply module 704. This is described below and illustrated in subsequent figures. Further, the light source modules 702 are configured to be easily removed and replaced thereby making maintenance and serviceability of the lamp 700 easier. In some embodiments, the light source modules 702 are tiltable in order to direct the light generated by the light source modules 702 as desired. In various embodiments of the light source modules 702, thermal management is accomplished using one of the cooling arrangements described above. Some embodiments of the light source modules 702 hold arrays of LED modules as described above. In these embodiments, the LED modules are replaceable generally making these embodiments more cost effective to maintain and repair.

In some embodiments of the fixture, the light source modules and power supply module are of similar size and shape and configured to assemble interchangeable and rearrangably. One advantage of this is aesthetic as the user can create a lamp according to a desired shape. Another advantage is that a lamp fixture can be assembled to direct light where it is needed. The modules are also replaceable which provides the advantage of easy and typically less expensive repair and typically less expensive maintenance compared to conventional lamps. In some embodiments, the modules are of compatible size and shape and retain the advantages of rearrangability and replacability. Finally, separate housing of the light sources and power supply provides an advantage to thermal management. First, the heat generating elements are distributed rather than concentrated in a single housing. Second, the module has only one type of heat generating element. Therefore, a cooling system most efficient for that element can be used. These advantages will be evident in the descriptions of embodiments below.

Figure 19:
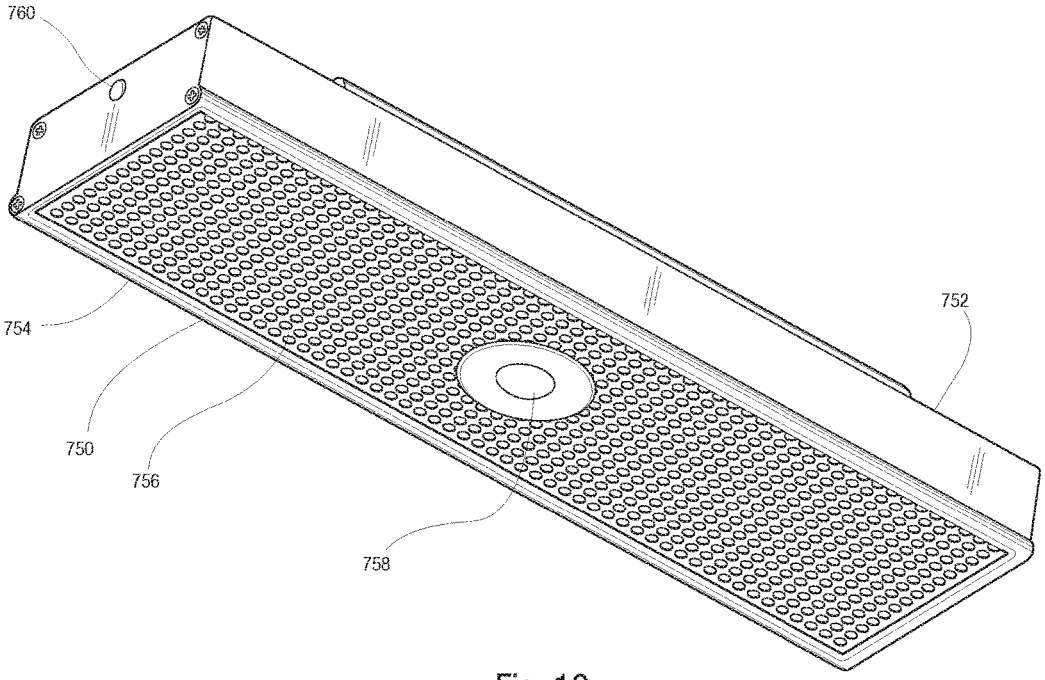
FIG. 19 is a perspective view of a power supply module of a modular lamp according to principles of the invention.

FIG. 19 is a perspective view of a power supply module 750 of a modular lamp according to one embodiment of the invention. The power supply module 750 includes a housing 752 having a top (not shown), a bottom 754 and four sides. In the present embodiment, electrical connection points 760, also referred to as mating elements, are located at either end of the housing 752. Connectors on light source modules in one embodiment are configured to mate with the power supply module 750 at the connection points 760 thereby establishing the electrical connection to power the light source modules. Alternatively, cable connections can be used to establish the electrical connection between modules. In an alternative embodiment, the mating elements 760 may also be used for mechanical connection between the power supply module and light source modules.

The top and bottom 754 of the power supply module 750 have openings that enable air to flow into and out of the module 750 for passive cooling of the power supply module 750. In the present embodiment, the bottom 754 of the module 750 is a screen 756 that enables air to flow into the module 750. The module 750 further includes sensors 758 as described above with regard to FIG. 18, or alternatively, a sensor and a transceiver. The air flow contributes to cooling the power supply module 750 while the sensors 756 contribute to its energy efficiency by controlling lamp operation in response to sensor data. Further, the separation of the power supply in a separate module away from the LEDs in the light source modules distributes heat generating elements in the modular lamp thereby improving overall thermal management.

Figure 20:
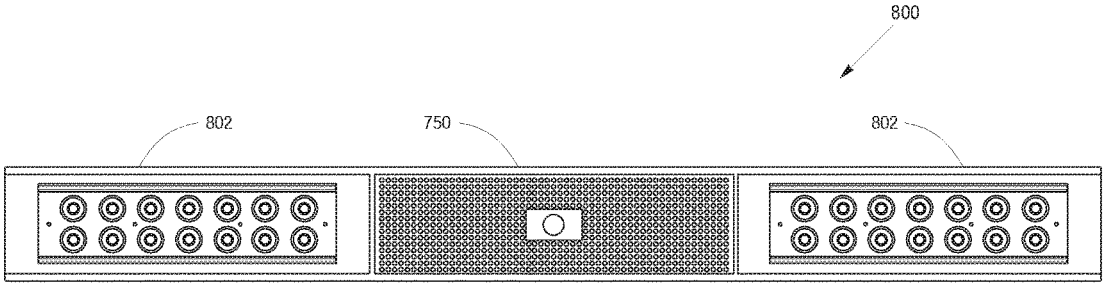
FIG. 20 is a bottom view of an embodiment of a modular solid-state lamp according to principles of the invention.

FIG. 20 is a bottom view of the modular solid-state lamp 800. The solid state lamp 800 of the present embodiment has three modules: a power supply module 750 and light source modules 802 connected to either end. The power supply module 750 is that as described above with regard to FIG. 19. The light source modules 802 each include a plurality of LEDs and thermal management elements as described in various embodiments herein.

The modules 750, 802 are elongated, narrow in one dimension and relatively long in another. The modules 750, 802 in the present lamp 800 are connected at narrow ends thereby forming an elongated lamp structure. The modules 750, 802 in a first arrangement are connected by means of brackets. Other connection means in other arrangements include screws, brackets, brackets with screws, mating slots, clamps, and plugs and receiving elements. One skilled in the art will recognize that the present invention is not limited to the mechanical connection methods listed here. In an alternative embodiment, the electronic connection between modules is combined with the mechanical connection.

Each of the modules 750, 802 is replaceable. Accordingly if one of the light source modules 802 or the power supply module 750 fails, the lamp 800 is easily repaired by replacing the failed module. Further, separation of heat generating elements in the modular lamp 800 into different modules, that is, locating LEDs in one module and the power supply in another module, improves thermal management. One reason that this arrangement is advantageous to cooling is that this arrangement prevents the additive heating that would occur if the LEDs and the power supply were in the same housing.

Figure 21A:
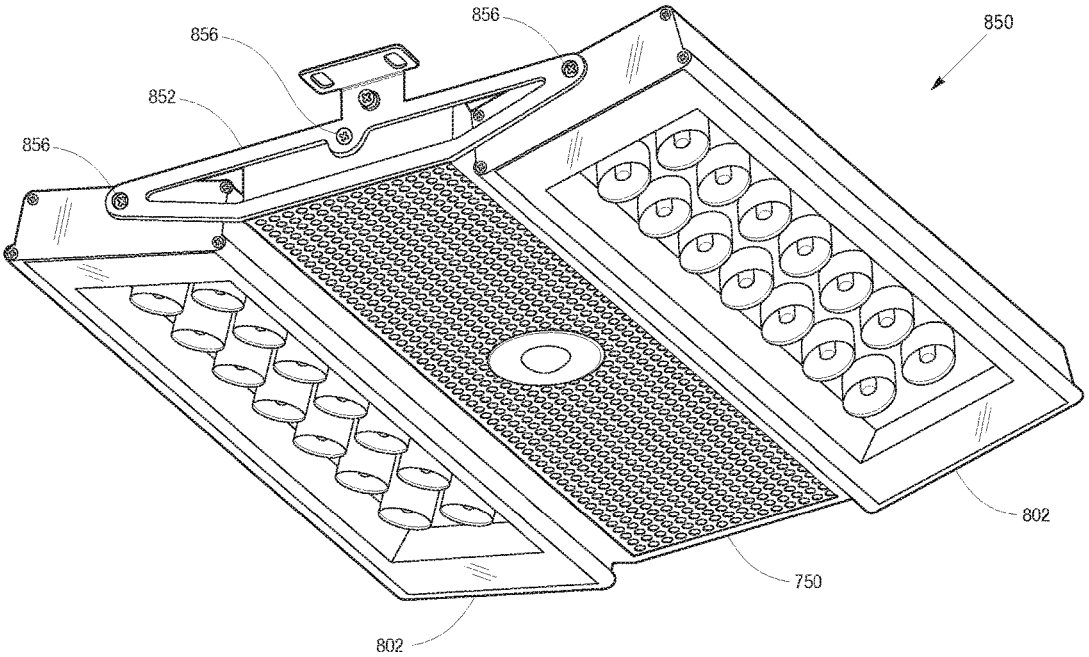
FIG. 21A is a bottom perspective view of an alternative embodiment of a solid-state lamp according to principles of the invention.

FIG. 21A is a bottom perspective view of a modular lamp 850 having an alternative arrangement to that shown above in FIG. 20. In this embodiment, the light source modules 802 are connected along the longer sides of the power supply module 750. The light source modules 802 in this embodiment are tiltable in order to direct light where desired. Each of the modules 750, 802 has at least one attachment point 856. Attachment points 856 on the modules 750, 802 align so that assembly can be accomplished. In this embodiment, the modules 750, 802 are connected together by means of brackets 852 which are attached using attachment points 856 on each of the modules 750, 802.

Figure 21B:
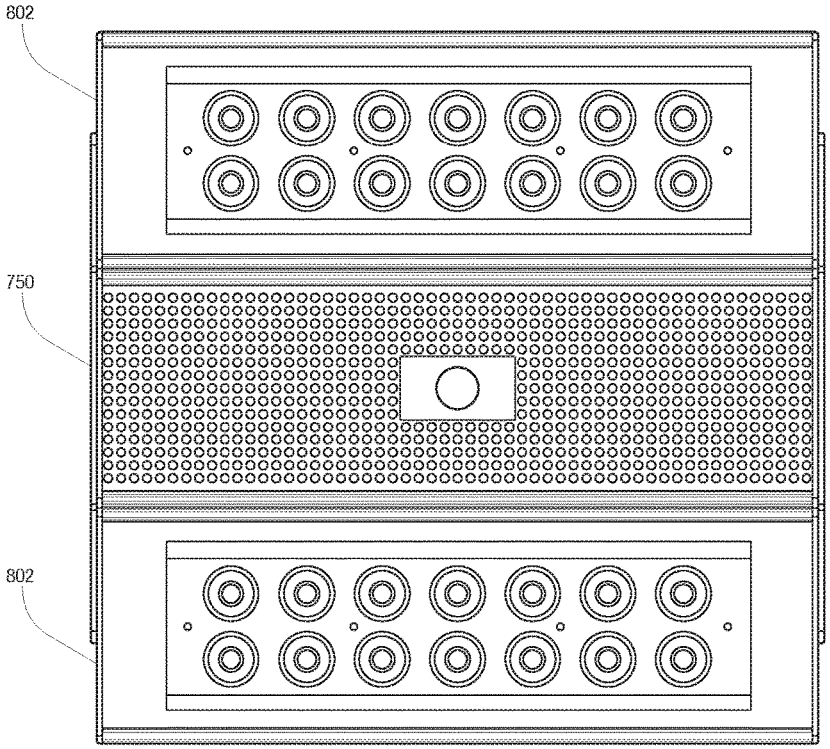
FIG. 21B is a bottom view of the second alternative embodiment of the solid-state lamp of FIG. 21A.
Figure 21C:
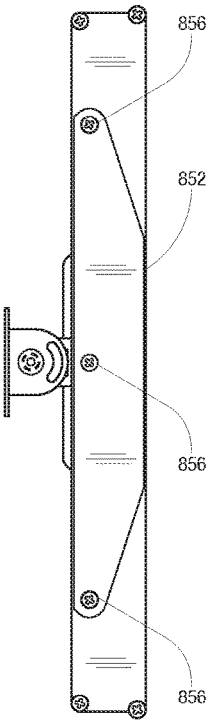
FIG. 21C is a right side view of the second alternative embodiment of the solid-state lamp of FIG. 21A.
Figure 21D:
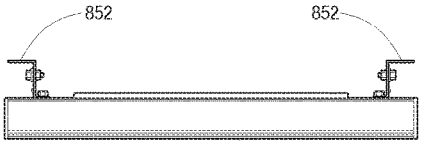
FIG. 21D is a front view of the second alternative embodiment of the solid-state lamp of FIG. 21A.
Figure 21E:
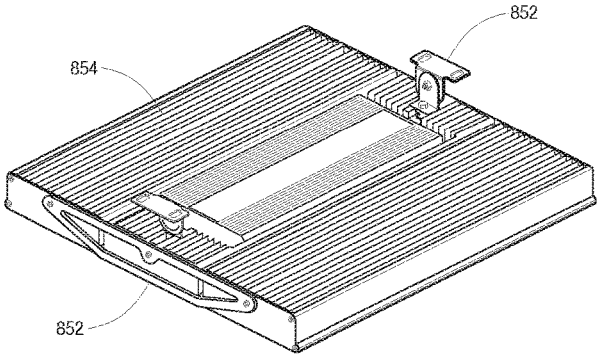
FIG. 21E is a top perspective view of the second alternative embodiment of the solid-state lamp of FIG. 21A.

FIG. 21B is a bottom view of the modular lamp 850. FIG. 21C is a side view, FIG. 21D is a front view, and FIG. 21E is a top perspective view. In these views, the modules are shown in an untilted position. In this embodiment, the tops of the housings of each of the modules 750, 802 includes a grill 854 providing openings for air flow through the modules 750, 802. One skilled in the art will recognize that present invention is not limited to the screen and the grill for providing openings for air flow through the modules.

Figure 22C:
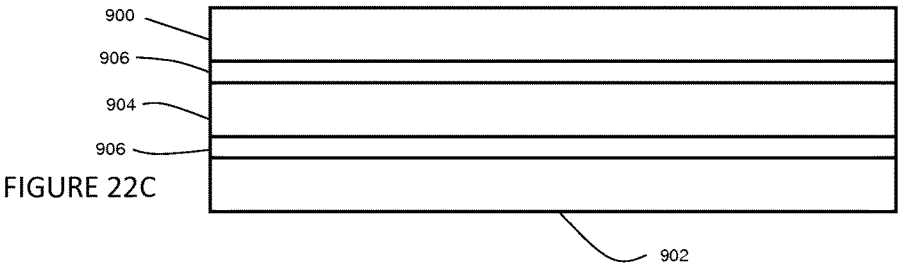
FIG. 22C is a top view of the heat sink of FIG. 22A.
Figure 22A:
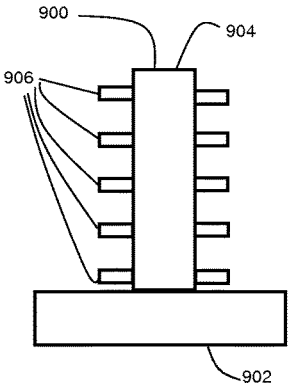
FIG. 22A is a front view of a heat sink according to one embodiment of the invention.
Figure 22B:
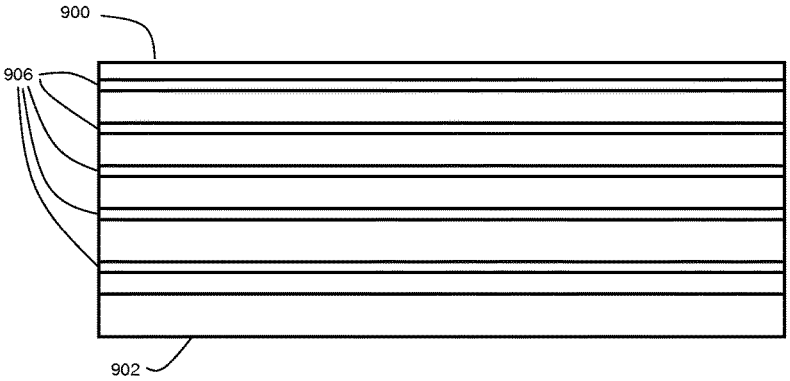
FIG. 22B is a right side view of the heat sink of FIG. 22A.

FIG. 22A is a front view of a heat sink 900; FIG. 22B is a right side view of the heat sink 900; and FIG. 22C is a top view of the heat sink 900. In some embodiments described above, the thermal management portion of a module includes a heat sink. Heat sinks of conventional design may be used as part of the cooling of the modular lamp as described above, however, a heat sink 900 as shown in FIGS. 22A, B and C may alternatively be used. The heat sink 900 has a base 902 that supports a single fin 904. Typically, a heat sink in a lamp would have a plurality of fins however, a single fin is shown here for the sake of clarity and convenience. The fin 904 includes a plurality of protrusions 906, or sub-fins that increase the overall surface area of the heat sink 900 without substantially increasing the space that the heat sink 900 occupies. The increased surface area enhances the heat sinks ability to transfer heat from itself to the surrounding environment.

Figure 23C:
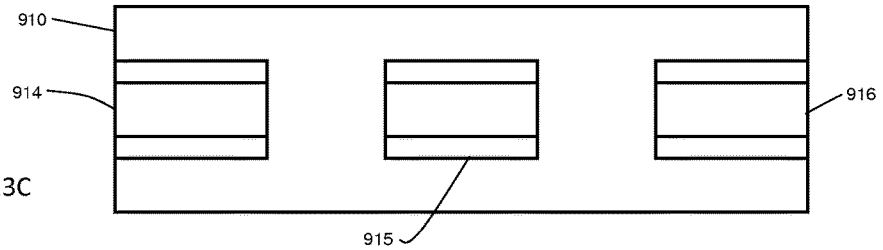
FIG. 23C is a top view of the heat sink of FIG. 23A.
Figure 23A:
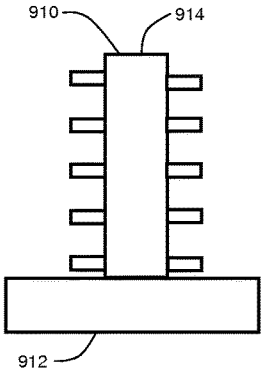
FIG. 23A is a front view of an alternative embodiment of a heat sink.
Figure 23B:
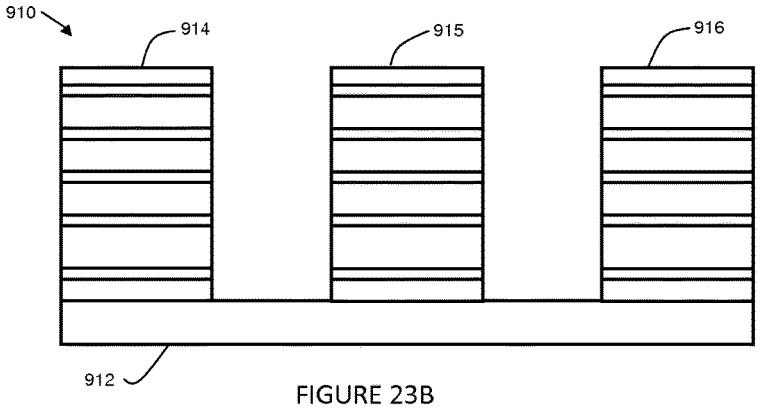
FIG. 23B is a right side view of the heat sink of FIG. 23A.

FIG. 23A is a front view of an alternative embodiment of a heat sink 910; FIG. 23B is a right side view of the heat sink 910; and FIG. 23C is a top view of the heat sink 910. The heat sink 910 has a base 912 that supports fins 914, 915, and 916. Each fin 914, 915 and 916 includes a plurality of protrusions 918 that increase the overall surface are of the heat sink 910.

Figure 24:
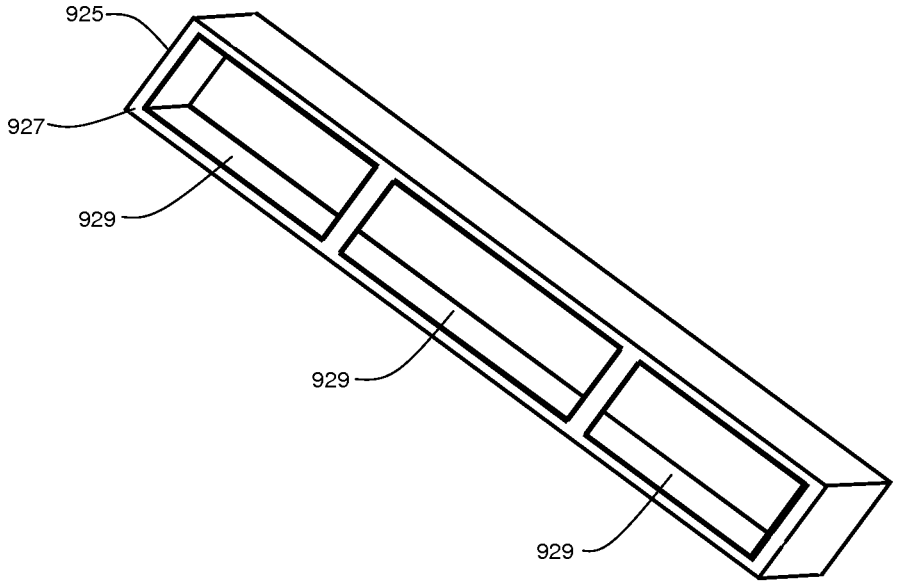
FIG. 24 is a perspective view of a frame to hold modules in a lamp according to one embodiment of the invention.

FIG. 24 is a bottom perspective view of a frame. The frame 925 is an alternative means for constructing a modular lamp according to one embodiment of the invention. The frame 925 is elongated similarly to the embodiment described above with regard to FIG. 20. One skilled in the art will understand that other frame configurations are possible within the scope of the invention. The frame in the present embodiment 925 is configured to hold two light source modules and a power supply module (not shown). The bottom 927 of the frame 925 has three openings 929 that are smaller than the modules such that the modules are supported by the bottom 927 of the frame 929. In various arrangements, the modules are held in the frame with connectors such as screws or clamps. The electronic connections between modules are for example cable connections however one skilled in the art will understand that other types of electronic connections are possible within the scope of the invention. Modules are easily placed and removed from the frame which provides the advantage that the lamp is easily maintained and repaired. Further the present embodiment enables decorative alternatives to be available in the form of various frames while using standardized light source and power supply modules.

Figure 25:
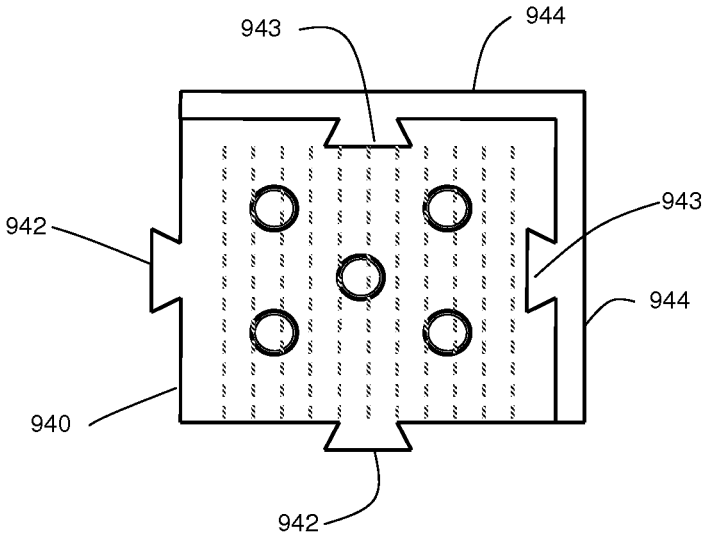
FIG. 25 is a top view of an LED module having an alternative configuration for lamp assembly.

FIG. 25 is a top view of an LED module having an alternative configuration for lamp assembly. The LED module 940 is generally rectangular. A dovetail 942 extends from each of two of the sides of the LED module 940. Each of the remaining sides of the LED module 940 has an opening 943 shaped and configured to receive dovetails. Each of the sides having an opening includes an extension 944 under the opening and extending away from the side of LED module 940. The LED module 940 is assembled into a lamp by using the dovetails 942 and openings 943 to connect them together similar to puzzle pieces The extensions 944 support the connected modules. Shapes other than the dovetail are possible within the scope of the invention.

Figure 26:
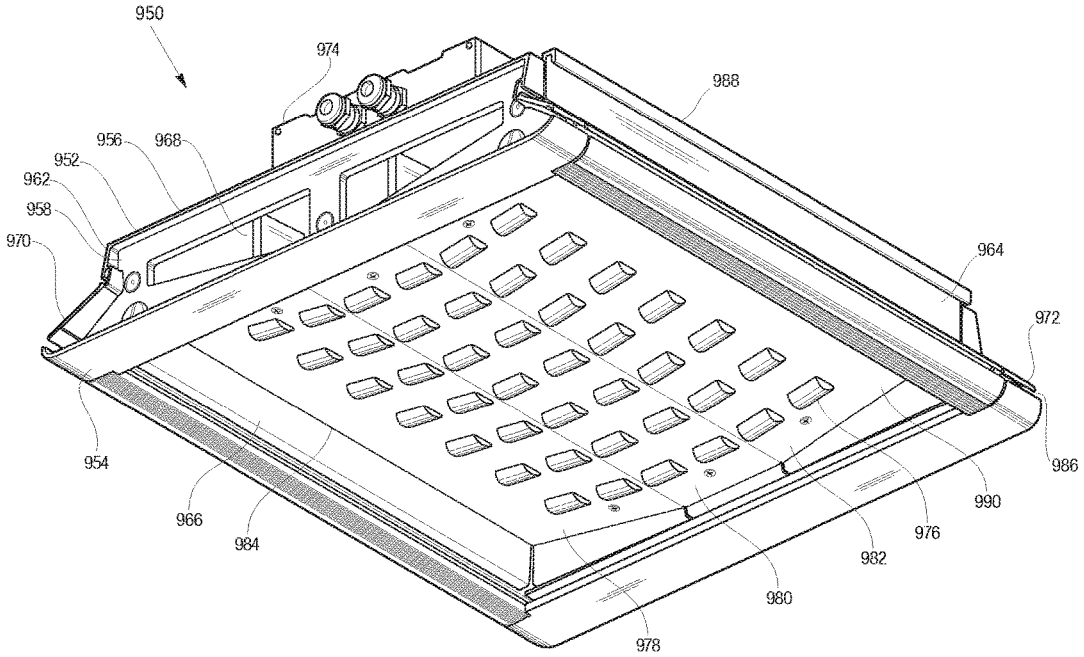
FIG. 26 is a bottom perspective view of an LED lamp assembly.

FIG. 26 shows a bottom perspective view of an embodiment of a lamp assembly 950 having modular components. The lamp assembly 950 includes a housing 952 having a bottom 954, a top 956, a front side 958, a back side 960 (not seen in this view), a left side 962, and a right side 964. The lamp bottom 954 has a large opening 966 typically including a lamp cover 984 that is typically transparent. The front side 958 of the housing 952 has at least one vent opening 968 that is generally uncovered. The back side 960 of the housing 952 similarly has at least one vent opening that is uncovered. The left side 962 and right side 964 of the housing 952 flare outwards to form substantially hollow flanges 970, 972. Each flange 970, 972 has a groove 986. In some embodiments, the groove 986 holds at least one sensor. Examples of sensors include light sensors and motion sensors. In an alternative embodiment, the lamp assembly 950 also includes a transceiver which is, for example, also positioned in the groove 986. A power supply 974 is located on the top 956 of the housing 952.

The lamp assembly 950 is mounted in place using railings. The right railing 988 is located at the upper right corner of the housing 952. The left railing is not seen in this view. In one arrangement, the housing 952 is mounted by sliding the housing horizontally along the railing which has a supporting portion to hold the housing in the railing. In another embodiment, one side of the housing 952 is hooked on one railing and the housing is then rotated upward to the other railing and pressed in to place. This method of mounting will be illustrated and described in further detail.

The housing 952 holds a plurality of light sources such as light emitting diodes (LEDs) arranged in LED modules. The modules are mounted in several panels 978, 980, 982, where each LED is located behind a lens 976. The panels 978, 980 and 982 are part of a frame 990 holding LED modules. The frame 990 is reflective. Each panel 978, 980, 982 of the frame 990 includes at least two angled extensions that are reflective. The frame 990 is made of aluminum, for example, that is polished on one side. The center panel 980 is substantially parallel to the housing bottom 954. The left panel 978 and right panel 982 are angled outward toward the left and right sides of the housing 952 respectively. Many LEDs emit highly directional light with peak luminous intensity normal to the surface of the LED. The angled panels increase the field of light emission from the lamp assembly. Further, the LEDs in the left panel 978 and right panel 982 are arranged with sufficient spacing from the left and right sides of the housing such that light emitted through the opening in the lamp bottom is maximized. The lens 976 that covers each LED further diffuses the LED light. The benefits of the angled panels can be seen particularly when the lamp assembly is used to illuminate aisles such as those found in stores and warehouses or used to illuminate parking structures or parking lots.

The lamp cover 984 in the housing bottom 954 is, in a first arrangement, made of glass. In alternative arrangements, the lamp cover 984 is made of plastic. The lamp cover 984 protects the LEDs modules mounted in the lamp assembly from dust and the elements, such as rain. The lamp cover 984 is set into the housing so that it can be readily removed and replaced. In one arrangement, the lamp cover 984 is set in to the large opening 966 of the housing 952 by means of a gasket that enables the cover 984 to be readily pulled out and replaced for servicing of the lamp assembly. This enables the lamp assembly to be serviced in the field. The lamp cover in one alternative embodiment includes a heating element to de-fog or de-ice the lamp cover 984 in inclement weather. The heating element typically takes heat generated by the LEDs. The lamp cover 984 and its setting into the housing will be described in greater detail below.

Figure 27:
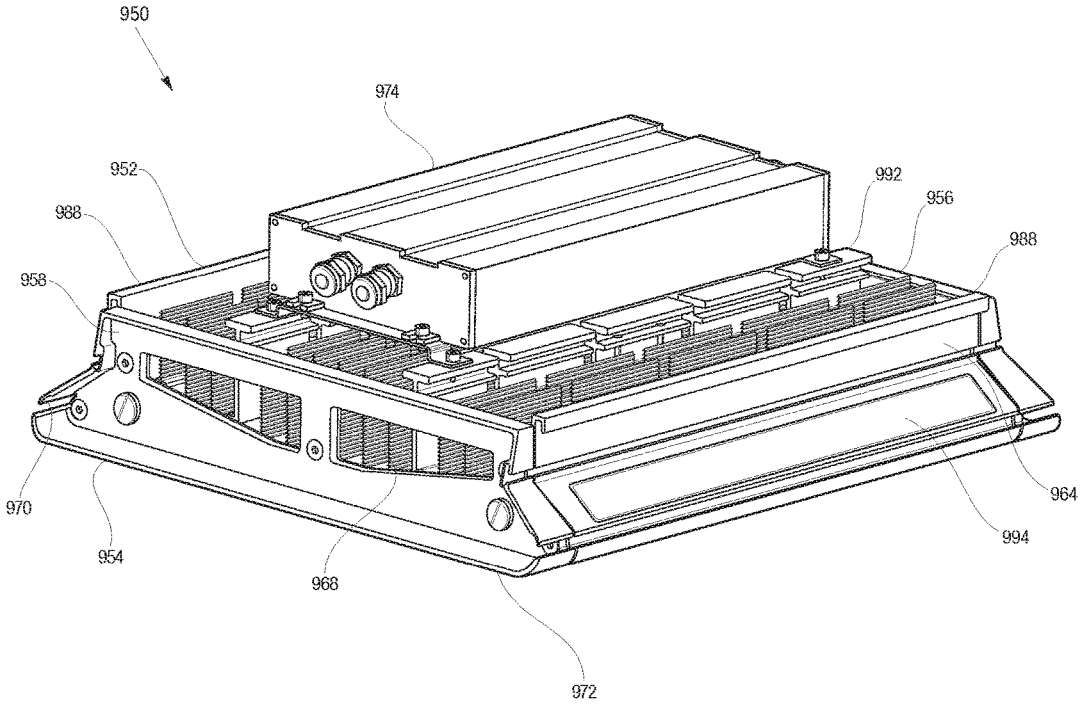
FIG. 27 is a top perspective view of the LED lamp assembly of FIG. 26.

FIG. 27 shows a top perspective view of the lamp assembly 950. Both railings 988 used in mounting the lamp assembly 950 are seen in this view. As described above, in one arrangement, the lamp assembly is mounted in place by sliding the housing into the railings which are in turn mounted to a pole or a ceiling or some other fixture. Other mounting arrangements are described below. The power supply 974 is mounted on a bridge 992. The top 956 of the housing 952 is substantially open to provide ventilation to the LED modules contained in the housing 952. Vent openings 968 at the front 958 and the back 960 sides of the housing also provide ventilation to the LED modules. The right and left sides of the housing includes flanges 970, 972. The upper portion of each flange includes an opening, also referred to as a window 994.

The lamp assembly 950 includes elements that enable light from the LED modules to be directed upward from the lamp assembly as well as downward. The LEDs in the lamp assembly 950 are directed substantially in a primary direction of illumination, which in this embodiment is downward. The angle of the light emitted by the LED modules is increased by setting some of the LED modules at an angle as described above. Extensions on the panels of the frame further distribute the light intensity in the downward direction. Some of this emitted light, however, is directed toward the flanges 970, 972. At least the lower portion of each flange has a reflective inner surface. Light is reflected by this reflective inner surface upward, in a secondary direction of illumination. The redirected light passes through the windows 994 in the flanges 970, 972. This light illuminates the space above the lamp assembly 950. Lamps that have strongly directed light such as LED lamps tend to create what is referred to as "the cave effect" where the ceiling of the lighted space is obscured in darkness above the lamp. The present lamp assembly with the upwardly directed light tends to avoid the cave effect.

Figure 28:
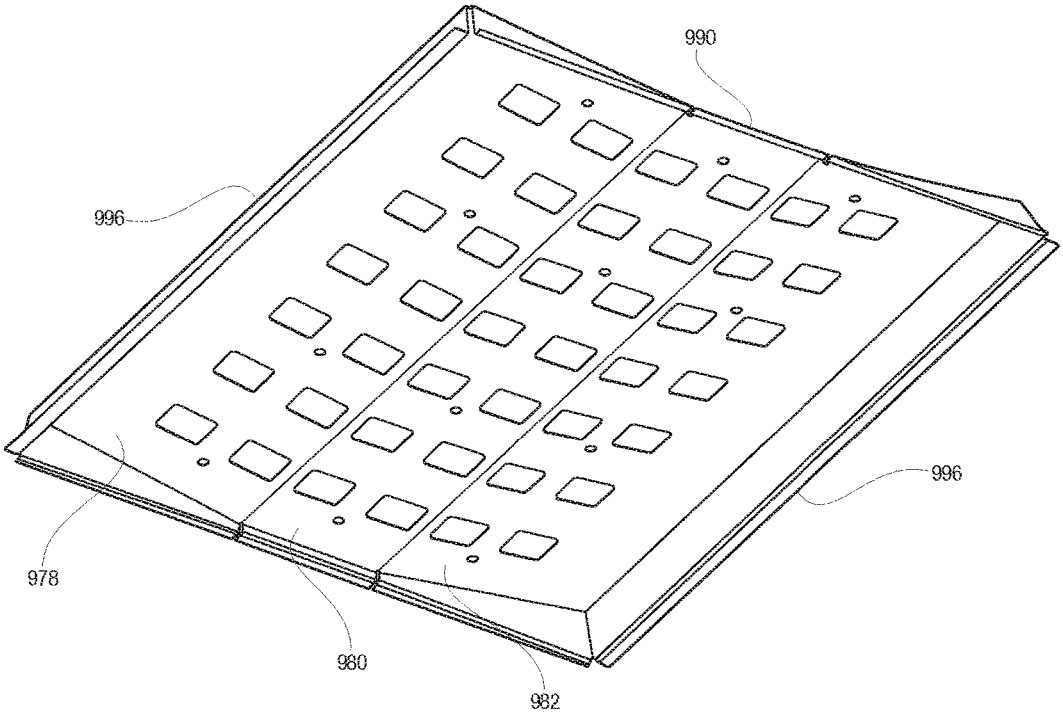
FIG. 28 is a perspective view of the frame of the LED lamp assembly of FIG. 26.

FIG. 28 is a bottom perspective view of the frame on which the LED modules of the lamp assembly are mounted. The frame 990 is made, for example, of aluminum. The upper surface of the frame 990 is typically not polished. The lower side of the frame 990 is a reflective surface, typically from polishing. Other materials for forming the frame are possible. For example the frame 990 in alternative arrangements is made of plastic, wood, or cardboard and the reflective surface is achieved by affixing or depositing a reflective film on the surface. A reflective surface can alternatively be achieved with a reflective paint. One of skill in the art will understand that the frame and reflective surface are not limited to those materials and methods described above.

The frame 990 has a left panel 978, a center panel 980 and a right panel 982. The left panel 978 and right panel 982 are angled outward away from the center panel 980. Each panel 978, 980, 982 has two or more angled extensions 996. Each extension 996 is angled generally toward the panel to which it is attached. LEDs tend to emit very directed light and the angled panels and extensions increase the angle of light emission from the lamp assembly. The reflective surfaces reflect light away from the frame.

Each panel 978, 980, 982 has a plurality of openings 998. At least one LED module is positioned on each panel 978, 980, 982 of the frame 990 where at least one LED is positioned over each opening 998 in the frame 990. Typically, for maintenance or repair, the LED modules are removed and replaced as needed.

Figure 29:
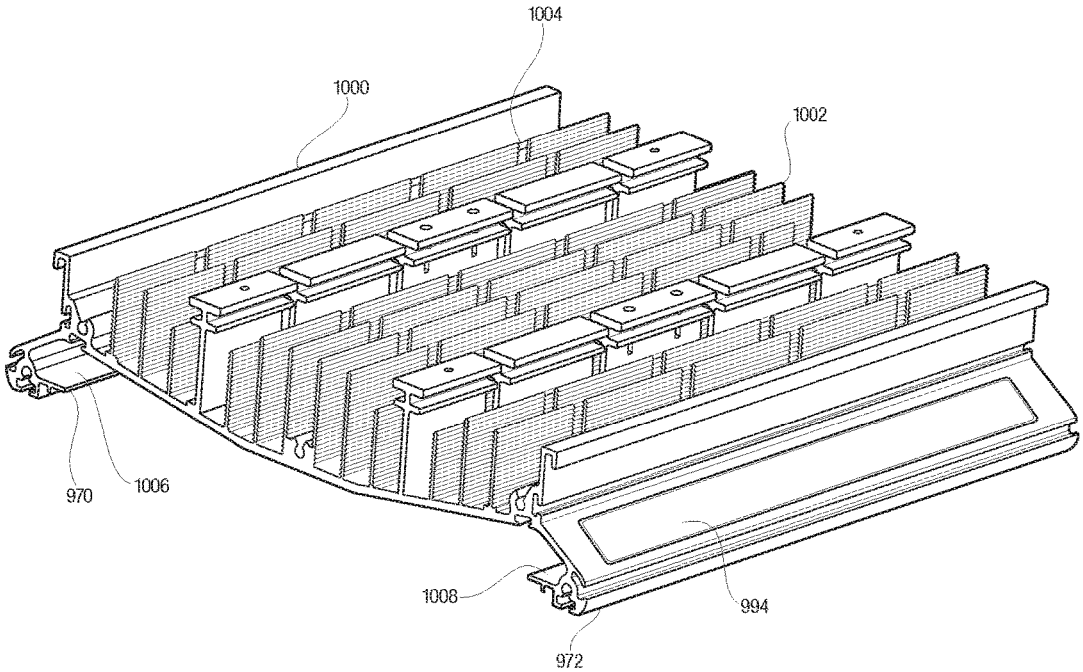
FIG. 29 is a perspective view of the upper portion of the housing of the LED lamp assembly of FIG. 26.

FIG. 29 shows the upper portion 1000 of the housing 952 holding a number of heat sinks 1002. The heat sinks 1002 are alternative embodiments of the finned heat sinks of FIGS. 22A, 22B and 22C. The heat sinks 1002 are arranged in rows where each row has one or more spaces 1004 making the rows of heat sinks discontinuous. The spaces 1004 allow for increased air circulation through the mounted heat sinks 1002.

The inner surfaces 1006, 1008 of each flange 970, 972 are seen in this view. The inner surfaces 1006, 1008 are reflective. In the lamp assembly in operation, light from the LED modules is reflected from the inner surfaces 1006, 1008 through the windows 994 in the flanges. This provides an upward directed light that enables the lamp assembly to avoid creating a cave effect in the space the lamp assembly illuminates.

Figure 30:
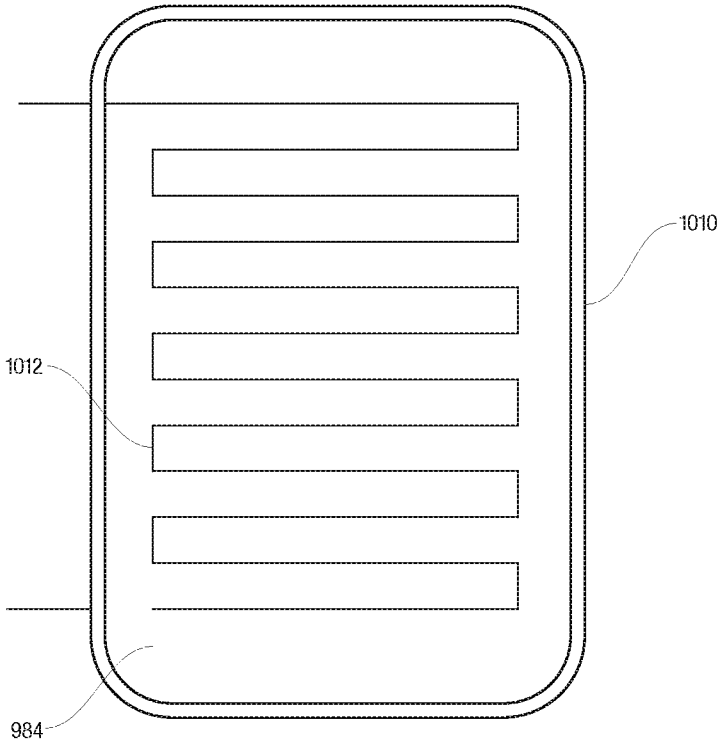
FIG. 30 is the lamp cover of the LED lamp assembly of FIG. 26, the lamp cover including a heating element.

FIG. 30 shows an embodiment of the lamp cover 984 for the lamp assembly 950 of FIG. 26. The lamp cover 984 is set into a gasket 1010. The gasket 1010 in turn would be set into the large opening 966 of the lamp assembly 950. The gasket 1010 enables the lamp cover 984 to be easily removed and replaced.

The lamp cover 984 further includes a heat element 1012. The heat element 1012 in a first embodiment is connected to the LED modules as described above and conducts heat from those modules to the lamp cover 984. The heat element 1012 warms the lamp cover 1012 for de-fogging or de-icing purposes. In an alternative embodiment, covers in the flange windows also include heating elements.

Figure 31:
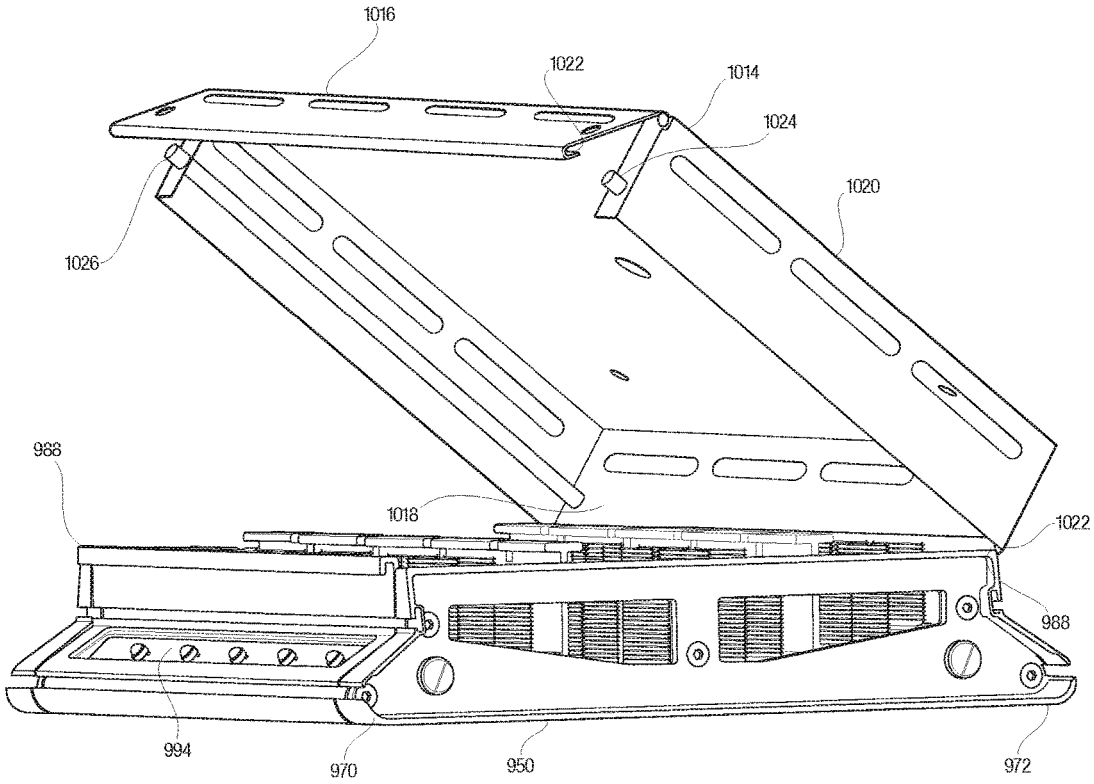
FIG. 31 is a perspective view of the LED lamp assembly of FIG. 26 and further including a top cover.

FIG. 31 is a perspective view of the lamp assembly 950 partially engaged with a top cover 1014. The top cover 1014 is a five-sided box 1016 with vent openings. In this embodiment of the top cover 1014, the left side 1016 of the top cover 1014 is hingeably attached to the top side 1020. The lower edges of the left 1016 and right 1018 sides of the top cover 1014 fold upward to form inwardly bent edges 1022 configured to engage with the railings 988 on the sides of the lamp assembly 950. A first rod 1024 and a second rod 1026 are located inside the top cover 1014 positioned perpendicularly to the sides 1016, 1018. The ends of each rod 1024, 1026 have external threads. The ends of each rod 1024, 1026 also project beyond the sides 1016, 1018 of the top cover 1014.

In mounting the lamp assembly 950 at a location, the top cover 1014 is set in place first. The lamp assembly 950 is then mounted into the top cover 1014 by first engaging the railing on the right side of the lamp assembly 950 with the right side of the top cover 1014. The bent edge and railing form a hinge. The lamp assembly 950 is rotated upward until it is in place to engage with the left side of the top cover. The left side 1016 opens to receive the lamp assembly 950 and the bent edge of the left side 1016 is engaged with the railing on the left side of the lamp assembly 950. The left side is then secured in place with nuts threaded over the ends of the rods 1024, 1026.

The hinged assembly enables partial engagement with the top cover as shown. This allows for wiring and other installation steps to be performed easily before finishing the installation by lifting the lamp assembly into final position.

Figure 32:
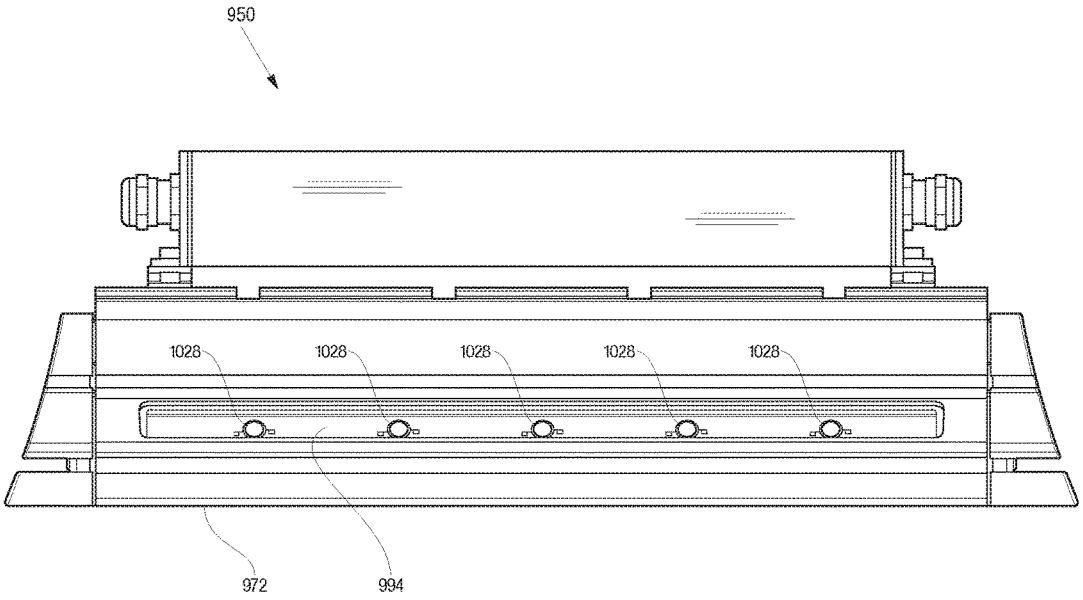
FIG. 32 is a perspective view of a flange of an alternative embodiment of an LED lamp assembly showing LEDs directed upward to increase the amount of uplight.

FIG. 32 is a side view of an alternative embodiment of an LED lamp assembly 950. In the hollow flange 972, LEDs 1028 are positioned behind the window 994 in the hollow flange 972. The LEDs 1028 are positioned so that they are substantially facing upward such that the emitted light directed substantially upward. The amount of uplight in this embodiment is increased generally over the amount in the reflective embodiments of the LED lamp assembly. This embodiment then further tends to reduce the cave effect that is common in LED lighting.

Figure 33:
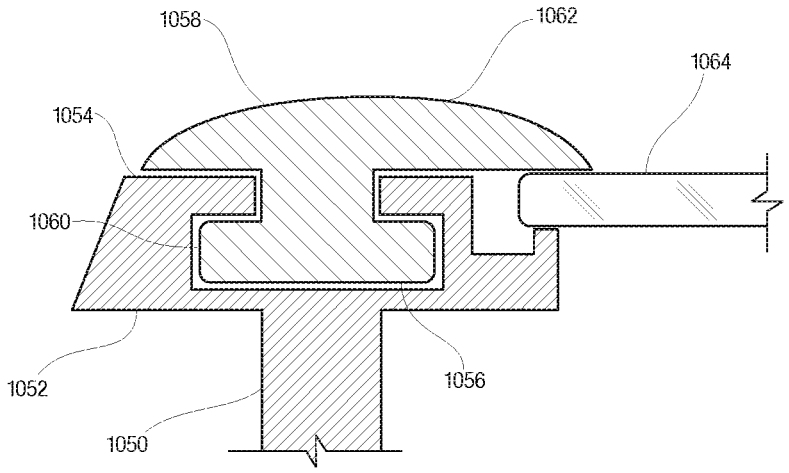
FIG. 33 is a partial side view of an alternative embodiment of the LED lamp assembly showing a lamp cover and gasket arrangement according to one embodiment.

FIG. 33 is a vertically flipped partial side view of an alternative embodiment of the LED lamp assembly showing a lamp cover and gasket arrangement according to one embodiment. The lamp housing 1050 has a top side 1052 and a bottom side 1054 and a gasket channel 1056. A gasket 1058 is roughly I-beam shaped where top bar 1060 of the I is configured to fit into the gasket channel 1056 of the housing 1050. The bottom bar 1062 of the I is configured to hold a lamp cover 1064 against the housing 1050. The flexible gasket 1058 is removable from the gasket channel 1056 enabling the lamp cover 1064 to be easily removed from the lamp assembly when the lamp assembly needs service. The gasket 1058, when in place, presses the lamp cover 1064 in place against the housing making a water resistant seal.

Solid state lamps according to embodiments of the invention are energy efficient both through the use of low-energy consumption light sources but also through the passive cooling of the design as well as through the sensors and controller that govern operation of the lamp such that light is provided when needed. The fixtures may be turned off or dimmed when light is not needed. Accordingly, the lamp assemblies are useful in energy efficient lighting systems as in the system described below with regard to FIGS. 34-36.

Figure 34:
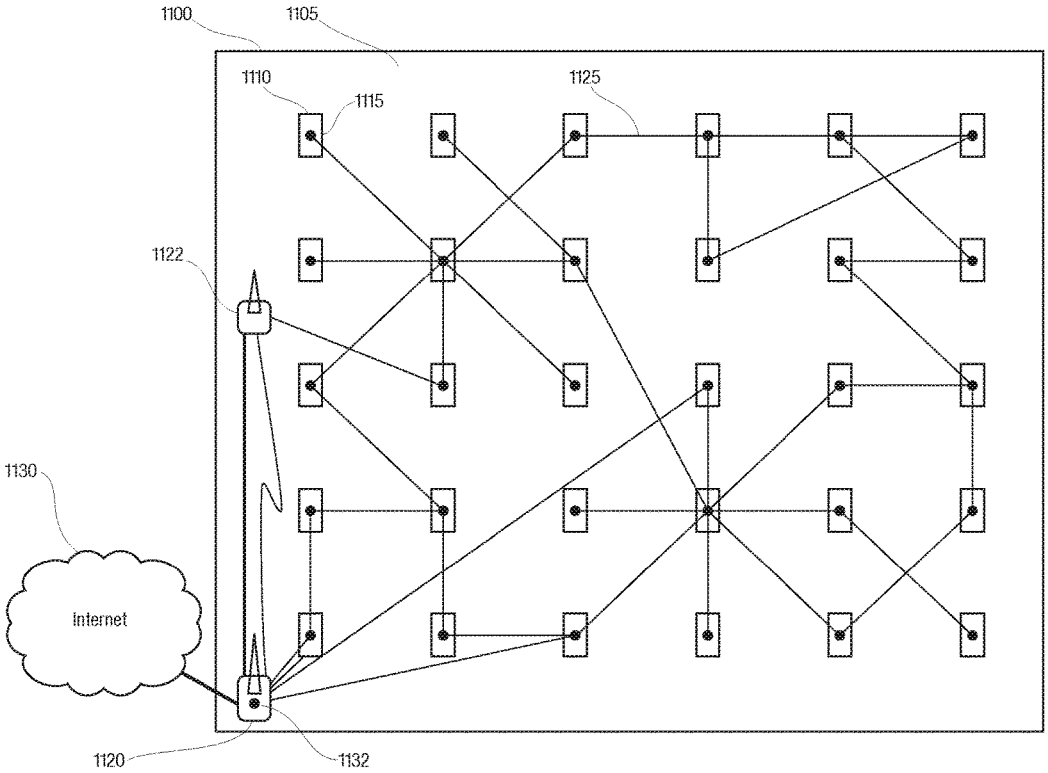
FIG. 34 is a block diagram showing an implementation of LED lamp assemblies in a warehouse.

FIG. 34 is a block diagram showing an implementation of embodiments of the light assembly in a lighting system. The block diagram shows a warehouse 1100 having a plurality of solid state lamps 1110 (also referred to as "lamp assemblies" or "lamps") distributed across the warehouse space 1105 to provide illumination. Each lamp 1110 includes a wireless transceiver and controller 1115. In some embodiments, the controller includes a timer. Further located in the warehouse 1100 are one or more wireless routers 1120, 1122. The wireless routers 1120, 1122 and transceivers 1115 in the lamps 1110 are in communication through a wireless mesh network 1125, such as a ZigBee network. ZigBee is a communications protocol based on the IEEE 802 personal area network standard. The mesh network 1125 is in communication with the Internet 1130 through an interface device which, in the present embodiment, is included in one 1120 of the routers. The router 1120 also includes a master controller 1132 to control the lighting system formed by the lamps 1110 connected through the mesh network 1125.

The lighting system shown in FIG. 34 operates efficiently by providing control over the lighting system to provide illumination where it is needed in the warehouse 1100 with rapid response time. In the present embodiment, the lighting system responds to the proximity of warehouse personnel. The lamps are off or at a low level of power when and where there are no workers present. As a worker approaches, the lamps in proximity provide increased illumination and decrease when the worker leaves the area. This is described in greater detail below with regard to FIG. 35.

Figure 35:
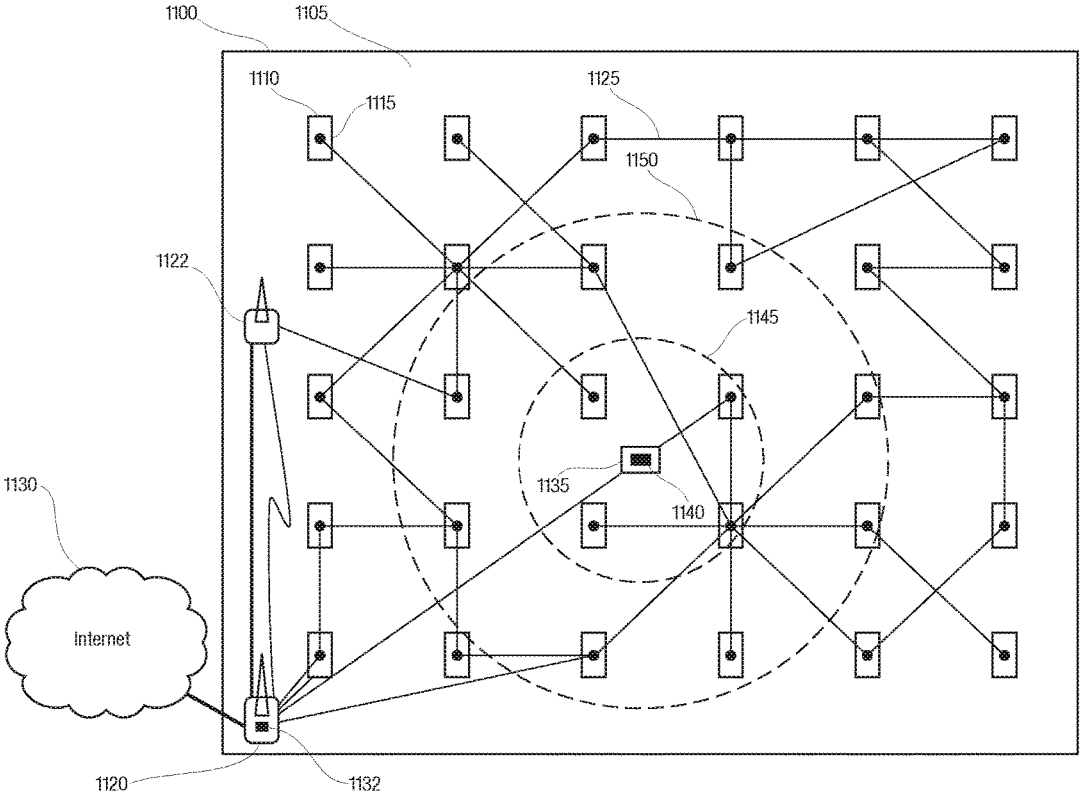
FIG. 35 is a block diagram further illustrating the implementation of FIG. 35; and, FIG. 36 is a flow chart showing the operation of the implementation of FIG. 34.

FIG. 35 is the block diagram of FIG. 34 further showing a warehouse worker 1135 in the warehouse 1100. The warehouse worker 1135 wears or carries a badge 1140 that is a radio-frequency transmitter. The transceivers 1115 in the lamps 1110 are capable of receiving a radio-frequency signal generated by the badge 1140. The warehouse worker 1135 is shown in the center of two concentric circles of proximity, an inner circle 1145 and an outer circle 1150. These circles 1145, 1150 represent the two distances at which the lamps operate at increased power in response to a signal from the badge and a determination that the lamps are proximate to the badge 1140. For example, the lamps outside both circles 1145, 1150 operate at 10% power. The lamps inside only the outer circle 1150, operate at 35% power and the lamps inside the inner circle 1145, operate at 100%. These levels of operation are merely exemplary. Other operation schema are possible within the scope of the present inventions. Further, while the circles of proximity are shown around the warehouse worker in this example, they are conceptually equivalent to proximity thresholds around each of the lamps. This is, each lamp has a first proximity threshold at a close distance and a second proximity threshold at a greater distance. The lamp operation is such that the lamp operates at a low level when there are no badges inside either proximity threshold. The lamp operates at a medium level when the lamp determines that a badge is inside the second threshold but not the first threshold and the lamp operates at some high level when the lamp determines that a badge is inside the first threshold.

In operation, the lamps 1110 sense the proximity of the worker 1135 based on the signal strength of the signal from the badge 1140. The lamps sensing a signal communicate with other lamps nearby in the mesh network to alert those lamps to the presence of a badge. If the controller in a lamp determines that it is within range of illumination, that is, within the outer circle but not the inner circle, then the controller operates the lamp at 35% power. If the controller in the lamp determines that the lamp is within the inner circle of proximity, then the controller operates the lamp at 100% power. As the worker moves about the space 1105, the controllers in the lamps respond by increasing or decreasing their power levels to provide more or less illumination. If there are multiple workers in the warehouse, the lamps respond equivalently. As the workers move about, those lamps falling within the outer circles of proximity around each worker turn up to a higher level of illumination and the lamps falling within the inner circles turn up to a higher level still of illumination. In a first embodiment, the level of illumination remains substantially constant as long as a lamp senses a proximate badge. In this way, the present system is advantageous over motion detector systems in that the lamps continue to provide light, that is, stay "on", even if the worker or workers in the area are stationary for prolonged periods of time. In an alternative embodiment, the controller, using its timer, remains at a constant level of power for some period of time after all badges leave the area of proximity. The period of time is for example 1 to 2 minutes.

The transceiver, controller and LEDs of LED lamps together make the lamps low latency devices able to respond quickly to the badge signals. Accordingly, the lighting system of the present embodiment is generally faster in its response time than conventional motion detector systems. Additionally, a radio-frequency system is advantageous over systems having line-of-sight sensors in settings like a warehouse because the line of sight may be blocked.

Further through the Internet connection, the lighting system may be monitored, controlled or reprogrammed remotely. The controller in each lamp is responsive to external control information received from the master controller or received through the Internet connection. The master controller, connected to the Internet, enables a user such as a building manager to control the lighting system remotely. Further, the master controller is able to collect data from the lamps in the lighting system. The Internet connection enables the lighting system to be observed remotely. In one embodiment, the lighting system is part of an electric utility's demand response system. The master controller receives signals from the electric utility regarding demand. The master controller then operates the lighting system in response to the demand signals. Participation in utility demand response programs typically lowers power costs for the customer.

Figure 36:
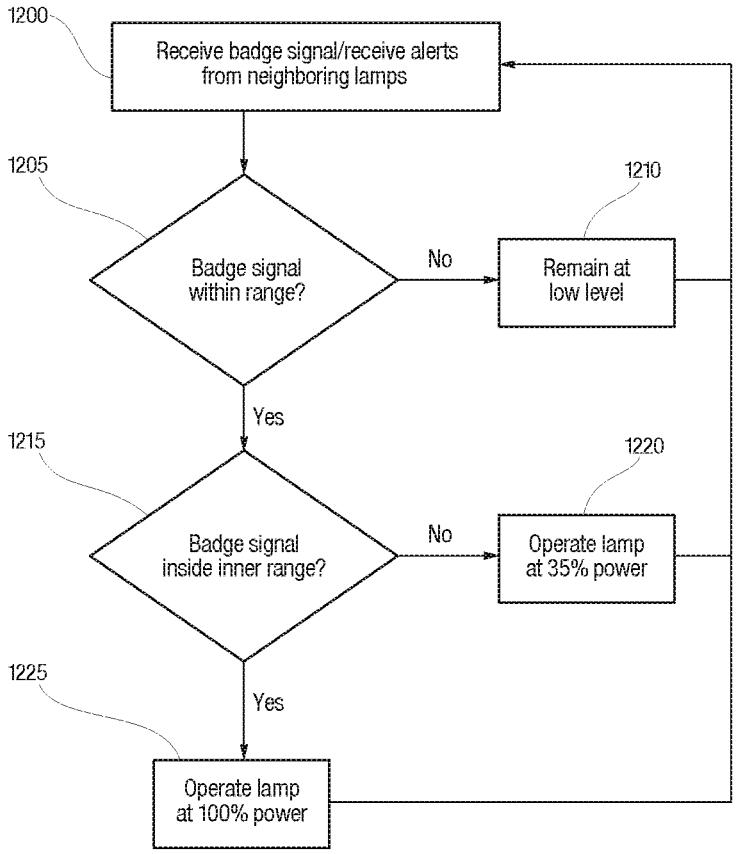

FIG. 36 shows a lamp process suitable for controlling lamps in the lighting system of FIGS. 34 and 35. At step 1200, the lamp transceiver receives at least one badge signal from one of the workers working in the warehouse. The lamp transceiver also receives alerts of the presence of at least one badge from other lamps in the warehouse mesh network.

At step 1205, the lamp controller determines from the received badge-generated signal or signals and from the alerts from other lamps whether there is a badge in proximity to the lamp. If there is no badge within lighting range, the lamp controller proceeds to step 1210. If there is a badge within range, the lamp controller proceeds to step 1215.

At step 1210, the lamp controller keeps the lamp at low power because there are no badges in proximity to it. The default low power level for the lamp in the example implementation provided above is at 10% power. The lamp controller also sends information through the transceiver to other lamps in the network that there are no badges and also, in some embodiments, forwards information received from other lamps regarding badge location. The lamp then returns to step 1200.

At step 1215, the lamp controller has determined that a badge is proximate to the lamp. In this step, the lamp controller determines whether the badge is close by, that is, whether the lamp is within the inner circle of proximity or only the outer circle of proximity around the badge. That is, the lamp controller determines whether a badge has crossed one of the proximate thresholds and then proceeds to determine which threshold. If the lamp is not within the inner circle of proximity, the controller proceeds to step 1220. If the lamp is within the inner circle of proximity, then the controller proceeds to step 1225.

At step 1220, the lamp controller, having determined that the lamp is inside the outer circle of proximity around at least one badge, operates the lamp at 35% power. The lamp sends an alert over the network that there is at least one badge in proximity. The lamp then returns to step 1200.

At step 1225, the lamp controller, having determined that the lamp is inside the inner circle of proximity around at least one badge, operates the lamp at 100% power. The lamp sends an alert over the network that there is at least one badge in proximity. The lamp then returns to step 1200.

It is to be understood that the above-identified embodiments are simply illustrative of the principles of the invention. Various and other modifications and changes may be made by those skilled in the art which will embody the principles of the invention and fall within the spirit and scope thereof.

I claim:

1. A lamp, comprising:

a frame supporting a plurality of LEDs provided on a plurality of panels, the LEDs substantially facing a primary direction of illumination, each of the plurality of panels positioned at a non-zero angle relative to the other panels in the plurality of panels; and a housing enclosing the frame, the housing having a bottom, a top, a front side, a back side, a left side, and a right side, the bottom including a first opening to allow emission of a first portion of light from the plurality of LEDs in the primary direction of illumination, the frame including a second opening located in opposition to the first opening to allow light emission in a secondary direction of illumination substantially opposite to the primary direction of illumination, the frame further including at least one reflective surface located between the first opening and the second opening to redirect a second portion of the light from the plurality of LEDs through the second opening in the secondary direction of illumination.

2. The lamp of claim 1 wherein the primary opening has a substantially transparent cover.

3. The lamp of claim 2 wherein the substantially transparent cover includes a heating element.

4. The lamp of claim 3 wherein the heating element collects heat from the plurality of LEDs.

5. The lamp of claim 2 wherein the substantially transparent cover is fitted into the primary opening with a gasket.

6. The lamp of claim 1 wherein the LEDs in the plurality of LEDs are configured in a plurality of modules.

7. The lamp of claim 6 wherein the modules are replaceable.

8. The lamp of claim 6 wherein the housing has a first vent opening on a first side and a second vent opening on a second side such that heat sinks on the LED modules are vented.

9. The lamp of claim 6 wherein each LED module has a plurality of heat sinks and wherein the heat sinks are arranged for improved air circulation.

10. The lamp of claim 1 wherein the plurality of panels further comprises a center panel, a left panel and a right panel.

11. The lamp of claim 10 wherein the left panel and right panel are angled toward the center panel.

12. The lamp of claim 1 wherein the at least one secondary opening has a substantially transparent cover.

13. The lamp of claim 12 wherein the substantially transparent cover of the at least one secondary opening includes a heating element.

14. The lamp of claim 1 further comprising a top cover having a top and four sides.

15. The lamp of claim 14 wherein the housing has railings and two opposing sides of the four sides of the top cover have inwardly bent edges, the railings and bent edges formed and configured to slidably mate.

16. The lamp of claim 14 wherein one side of the top cover is hingeably attached to the top, wherein the housing has railings and wherein the hingeably attached side and its opposing side have inwardly bent edges, wherein the railings and bent edges are formed and configured to engage first on the opposing side and then on the hingeably attached side.

17. The lamp of claim 1 wherein each panel of the frame has at least one angled extension, each angled extension being angled toward the panel to which the angled extension is attached.

18. The lamp of claim 1 wherein the primary opening is a downward facing opening and the secondary opening is an upward facing opening such that the secondary direction of illumination is up.

* * * * *